US009126326B1

(12) United States Patent
Bowen et al.

(10) Patent No.: US 9,126,326 B1
(45) Date of Patent: Sep. 8, 2015

(54) ATTACHMENT DEVICE FOR AN AUTOMOTIVE CREEPER AND MECHANICS CHAIR USING THE SAME

(71) Applicants: Craig Eugene Bowen, Lancaster, OH (US); Richard Mark Spring, Lancaster, OH (US)

(72) Inventors: Craig Eugene Bowen, Lancaster, OH (US); Richard Mark Spring, Lancaster, OH (US)

( * ) Notice: Subject to any disclaimer, the term of this patent is extended or adjusted under 35 U.S.C. 154(b) by 0 days.

(21) Appl. No.: 14/164,430

(22) Filed: Jan. 27, 2014

Related U.S. Application Data

(60) Provisional application No. 61/757,680, filed on Jan. 28, 2013.

(51) Int. Cl.
*B25H 5/00* (2006.01)

(52) U.S. Cl.
CPC ..... *B25H 5/00* (2013.01)

(58) Field of Classification Search
CPC ..... B62B 5/0083; B62B 2206/02; B25H 5/00
USPC ..... 280/32.6, 79.11, 35, 638
See application file for complete search history.

(56) References Cited

U.S. PATENT DOCUMENTS

| | | | | |
|---|---|---|---|---|
| 4,986,558 | A | 1/1991 | Morris | |
| 5,378,003 | A | 1/1995 | Burd et al. | |
| 5,494,305 | A | 2/1996 | Chen | |
| 5,503,415 | A | 4/1996 | Powell | |
| 5,624,126 | A | 4/1997 | Vosbikian et al. | |
| D406,432 | S | 3/1999 | Taylor et al. | |
| D406,433 | S | 3/1999 | Taylor et al. | |
| D406,683 | S | 3/1999 | Taylor et al. | |
| D406,684 | S | 3/1999 | Pool et al. | |
| 6,238,069 | B1 | 5/2001 | Miles | |
| 6,371,496 | B1 * | 4/2002 | Balolia | 280/35 |
| 6,540,378 | B2 | 4/2003 | Alsup | |
| 7,032,907 | B1 | 4/2006 | Marsh | |
| 7,032,908 | B2 | 4/2006 | Melvin | |
| 7,273,215 | B1 | 9/2007 | Smith | |
| 7,374,181 | B1 * | 5/2008 | Wu | 280/32.6 |
| 7,434,817 | B2 | 10/2008 | Rush | |
| 2006/0285404 | A1 * | 12/2006 | Alexander | 365/200 |
| 2010/0079985 | A1 | 4/2010 | Prosey | |
| 2010/0123293 | A1 | 5/2010 | Benjamin | |
| 2011/0063821 | A1 | 3/2011 | Prosey | |
| 2011/0227303 | A1 | 9/2011 | Gering | |

* cited by examiner

*Primary Examiner* — Brodie Follman
*Assistant Examiner* — Brian Cassidy
(74) *Attorney, Agent, or Firm* — The Law Office of Patrick F. O'Reilly III, LLC

(57) ABSTRACT

An attachment device configured to be attached to opposed sides of an automotive creeper is disclosed herein. The attachment device includes: a first generally L-shaped member, a second generally L-shaped member, a connecting member slidably coupling the first generally L-shaped member to the second generally L-shaped member, and at one least pair of securement devices configured to respectively attach the first and second generally L-shaped members to the automotive creeper. In one or more embodiments, a width of the attachment device is selectively adjustable so as to accommodate a plurality of different automotive creepers having varying widths. An automotive creeper system and a mechanics chair using the attachment device are also disclosed herein.

20 Claims, 34 Drawing Sheets

ATTACHMENT DEVICE FOR AN AUTOMOTIVE CREEPER AND MECHANICS CHAIR USING THE SAME

CROSS-REFERENCE TO RELATED APPLICATIONS

This patent application claims priority to, and incorporates by reference in its entirety, U.S. Provisional Patent Application No. 61/757,680, entitled "Attachment Device For An Automotive Creeper And Mechanics Chair Using The Same", filed on Jan. 28, 2013.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to an attachment device for an automotive creeper and mechanics chair using the same. More particularly, the invention relates to an attachment device that is adapted to be used with existing automotive creepers, and a mechanics chair that is designed to be used with the attachment device.

2. Background and Description of Related Art

Mechanics often use creepers to service the undercarriage of vehicles. Some sort of light source must be used. Mechanics are often working in tight spaces and may need to hold a light while holding other tools. If lights with cords are used, the cords may get in the way and get caught on the creeper wheels. This repair process often makes it hard to shine light on the spot needed to complete the repair. The same problem of light applies to the mechanics chair. Also, the typical mechanics chair is very easy to tip over backwards.

In addition, conventional creepers are designed to have a standard length, which does not comfortably accommodate all individuals that use them. In particular, relatively tall individuals are normally uncomfortable when using a conventional creeper because their head and neck area are disposed well beyond the head end of the creeper when laying thereon. As a result, taller individuals often experience neck fatigue and discomfort, especially when utilizing a conventional creeper for an extended period of time.

Therefore, what is needed is an attachment device that can be quickly and easily attached to automotive creepers of varying size so that accessories, such as a headrest and/or lights, may be simply attached thereto. Moreover, an attachment device is needed that is capable of increasing the user comfort associated with automotive creepers, particularly for individuals having a taller stature. Furthermore, there is a need for a mechanics chair, which does not easily tip over, and provides increased back and neck support during use so that user fatigue and discomfort can be minimized during vehicle repairs.

BRIEF SUMMARY OF EMBODIMENTS OF THE INVENTION

Accordingly, the present invention is directed to an attachment device for an automotive creeper and a mechanics chair using the same, which substantially obviates one or more problems resulting from the limitations and deficiencies of the related art.

In accordance with one aspect of the present invention, there is provided an attachment device configured to be attached to opposed sides of an automotive creeper, which includes: a first generally L-shaped member, the first generally L-shaped member including a head portion and a side portion, the head portion of the first generally L-shaped member having an end; a second generally L-shaped member, the second generally L-shaped member including a head portion and a side portion, the head portion of the second generally L-shaped member having an end; a connecting member, the connecting member slidably coupling the end of the head portion of the first generally L-shaped member to the end of the head portion of the second generally L-shaped member; and at one least pair of securement devices, a first of the at least one pair of securement devices configured to attach the side portion of the first generally L-shaped member to a first side member of an automotive creeper, and a second of the at least one pair of securement devices configured to attach the side portion of the second generally L-shaped member to a second side member of the automotive creeper, the second side member of the automotive creeper being disposed generally opposite to the first side member of the automotive creeper. In this embodiment, a width of the attachment device is selectively adjustable so as to accommodate a plurality of different automotive creepers having varying widths.

In a further embodiment of this aspect of the present invention, the first and second generally L-shaped members are in the form of generally L-shaped tubular members.

In yet a further embodiment, the head portions of the first and second generally L-shaped members are disposed at substantially ninety degree angles relative to respective side portions of the first and second generally L-shaped members.

In still a further embodiment, the first and second generally L-shaped members are in the form of generally L-shaped tubular members, wherein the head portions of the first and second generally L-shaped members are disposed at substantially ninety degree angles relative to respective the side portions of the first and second generally L-shaped members; and wherein the side portions of the first and second generally L-shaped members are each bent at an angle near a head end of the attachment device so as to accommodate an inclined head position of a user disposed on the automotive creeper.

In yet a further embodiment, the connecting member comprises a generally straight member, the generally straight member having a first end, a second end and a cross-sectional area, the cross-sectional area of the generally straight member being less than a cross-sectional area of the first and second generally L-shaped members, the first end of the generally straight member fixedly secured to the end of the head portion of the first generally L-shaped member, the second end of the generally straight member slidably engaging the end of the head portion of the second generally L-shaped member.

In still a further embodiment, the head portion of the second generally L-shaped member comprises a fastener threadingly disposed in an aperture thereof, the fastener configured to be tightened against an outer surface of the generally straight member so as to fix the position of the first generally L-shaped member relative to the second generally L-shaped member.

In yet a further embodiment, the connecting member comprises a generally T-shaped member having a base portion and a cross-piece connected to an end of the base portion, the cross-piece of the generally T-shaped member having first and second opposed ends and a cross-sectional area, at least a portion of the cross-sectional area of the cross-piece being less than a cross-sectional area of the first and second generally L-shaped members, the first end of the cross-piece of the generally T-shaped member slidably engaging the end of the head portion of the first generally L-shaped member, the second end of the cross-piece of the generally T-shaped member slidably engaging the end of the head portion of the second generally L-shaped member.

In still a further embodiment, the head portion of the first generally L-shaped member comprises a first fastener threadingly disposed in an aperture thereof, the head portion of the second generally L-shaped member comprises a second fastener threadingly disposed in an aperture thereof, the first and second fasteners configured to be tightened against respective outer surfaces of the generally T-shaped member proximate to respective first and second ends of the cross-piece of the generally T-shaped member so as to fix the position of the first generally L-shaped member relative to the second generally L-shaped member.

In yet a further embodiment, the attachment device further comprises a headrest attached to the generally T-shaped member.

In still a further embodiment, an angle of the headrest is selectively adjustable by a user.

In yet a further embodiment, the attachment device further comprises a headrest attached to the head portions of the first and second generally L-shaped members.

In still a further embodiment, the attachment device further comprises one or more light emitting devices for providing light to an area of a vehicle being serviced.

In yet a further embodiment, the one or more light emitting devices comprise light emitting diode (LED) lamps.

In still a further embodiment, the one or more light emitting devices comprise a plurality of light emitting devices spaced apart along the length of at least one of the following: (i) the side portion of the first generally L-shaped member, (ii) the head portion of the first generally L-shaped member, (iii) the side portion of the second generally L-shaped member, and (iv) the head portion of the second generally L-shaped member.

In yet a further embodiment, the plurality of light emitting devices are spaced apart along the length of the side portions of the first and second generally L-shaped members and the head portions of the first and second generally L-shaped members.

In still a further embodiment, the one or more light emitting devices comprise a plurality of removable light emitting devices, each of the plurality of removable light emitting devices comprising one or more magnets for attaching the removable light emitting devices to the attachment device.

In yet a further embodiment, the attachment device further comprises a rechargeable battery pack for powering the one or more light emitting devices.

In still a further embodiment, the rechargeable battery pack further comprises an accessory jack for powering one or more accessory devices.

In yet a further embodiment, the one or more accessory devices comprise a handheld light or an ultraviolet light.

In still a further embodiment, the attachment device further comprises an audio device and one or more speakers operatively coupled thereto.

In yet a further embodiment, the audio device comprises one of: (i) a AM/FM radio, (ii) an MP3 player, and (iii) a compact disk player.

In still a further embodiment, the one or more speakers comprise a plurality of speakers, a first of the plurality of speakers being disposed near a corner of the first generally L-shaped member, and a second of the plurality of speakers being disposed near a corner of the second generally L-shaped member.

In accordance with another aspect of the present invention, there is provided an automotive creeper system that includes: an automotive creeper, the automotive creeper including a first side member and a second side member, the second side member of the automotive creeper being disposed generally opposite to the first side member of the automotive creeper; and an attachment device coupled to the first and second side members of the automotive creeper. The attachment device including a first generally L-shaped member, the first generally L-shaped member including a head portion and a side portion, the head portion of the first generally L-shaped member having an end; a second generally L-shaped member, the second generally L-shaped member including a head portion and a side portion, the head portion of the second generally L-shaped member having an end; a connecting member, the connecting member slidably coupling the end of the head portion of the first generally L-shaped member to the end of the head portion of the second generally L-shaped member; and at one least pair of securement devices, a first of the at least one pair of securement devices attaching the side portion of the first generally L-shaped member to the first side member of the automotive creeper, and a second of the at least one pair of securement devices attaching the side portion of the second generally L-shaped member to the second side member of the automotive creeper. In this embodiment, a width of the attachment device is selectively adjustable so as to accommodate a plurality of different automotive creepers having varying widths.

In a further embodiment of this aspect of the present invention, the head portions of the first and second generally L-shaped members are disposed at substantially ninety degree angles relative to respective side portions of the first and second generally L-shaped members.

In yet a further embodiment, the connecting member comprises a generally straight member, the generally straight member having a first end, a second end and a cross-sectional area, the cross-sectional area of the generally straight member being less than a cross-sectional area of the first and second generally L-shaped members, the first end of the generally straight member fixedly secured to the end of the head portion of the first generally L-shaped member, the second end of the generally straight member slidably engaging the end of the head portion of the second generally L-shaped member.

In still a further embodiment, the connecting member of the attachment device comprises a generally T-shaped member having a base portion and a cross-piece connected to an end of the base portion, the cross-piece of the generally T-shaped member having first and second opposed ends and a cross-sectional area, at least a portion of the cross-sectional area of the cross-piece being less than a cross-sectional area of the first and second generally L-shaped members, the first end of the cross-piece of the generally T-shaped member slidably engaging the end of the head portion of the first generally L-shaped member, the second end of the cross-piece of the generally T-shaped member slidably engaging the end of the head portion of the second generally L-shaped member.

In yet a further embodiment, the attachment device further comprises a headrest attached to the generally T-shaped member.

In still a further embodiment, the attachment device further comprises one or more light emitting devices for providing light to an area of a vehicle being serviced.

In yet a further embodiment, the one or more light emitting devices comprise a plurality of removable light emitting devices, each of the plurality of removable light emitting devices comprising one or more magnets for attaching the removable light emitting devices to the attachment device.

In still a further embodiment, the automotive creeper system further comprises a tool tray, the tool tray including an outwardly extending frame member, and wherein the automotive creeper further includes a plurality of spaced apart, transverse frame members connected to each of the first and second members of the automotive creeper, one or more of the transverse frame members of the automotive creeper including an open end for receiving the outwardly extending frame member of the tool tray so that the tool tray is capable of being detachably coupled to the automotive creeper.

In accordance with yet another aspect of the present invention, there is provided a mechanics chair that includes: a seat portion, the seat portion including a plurality of seat members, a first of the plurality of seat members being laterally spaced apart from a second of the plurality of seat members; a seat back portion coupled to the seat portion, the seat back portion including a plurality of seat back members, a first of the plurality of seat back members being laterally spaced apart from a second of the plurality of seat back members; a base portion, the base portion including a plurality of base members, a first of the plurality of base members being laterally spaced apart from a second of the plurality of base members, at least one of the plurality of base members extending beyond the seat back portion of the mechanics chair so as to prevent the tipping thereof; and a leg structure coupling the seat portion to the base portion, the leg structure including a plurality of generally vertical leg members, each of the plurality of generally vertical leg members spaced apart from one another, a first of the plurality of generally vertical leg members coupling the first of the plurality of base members to the first of the plurality of seat members, and a second of the plurality of generally vertical leg members coupling the second of the plurality of base members to the second of the plurality of seat members.

In a further embodiment of this aspect of the present invention, the plurality of seat members comprise a first pair of seat side members and a second pair of transverse seat members, the seat side members being spaced apart from one another by the length of the transverse seat members.

In yet a further embodiment, each of the seat side members is disposed generally perpendicular to each of the transverse seat members.

In still a further embodiment, the plurality of seat members comprise a first pair of seat side members and a second pair of transverse seat members, the seat side members being spaced apart from one another by the length of the transverse seat members; and wherein each of the seat side members is disposed generally perpendicular to each of the transverse seat members.

In yet a further embodiment, the plurality of seat back members comprise a pair of seat back side members and a transverse seat back member, the seat back side members being spaced apart from one another by the length of the transverse seat back member.

In still a further embodiment, each of the seat back side members is disposed generally perpendicular to the transverse seat back member.

In yet a further embodiment, the plurality of seat back members comprise a pair of seat back side members and a transverse seat back member, the seat back side members being spaced apart from one another by the length of the transverse seat back member; and wherein each of the seat back side members is disposed generally perpendicular to the transverse seat back member.

In still a further embodiment, the plurality of base members comprises a pair of base side members and a transverse base member, the base side members being spaced apart from one another by the length of the transverse base member.

In yet a further embodiment, each of the base side members is disposed generally perpendicular to the transverse base member.

In still a further embodiment, each of the base side members extend beyond the seat back portion of the mechanics chair so as to prevent the tipping thereof.

In yet a further embodiment, each of the base side members comprises a plurality of wheels coupled thereto, at least one of the plurality of wheels on each base side member being disposed rearwardly of the seat back portion of the mechanics chair so as to prevent the tipping thereof.

In still a further embodiment, the plurality of base members comprises a pair of base side members and a transverse base member, the base side members being spaced apart from one another by the length of the transverse base member; wherein each of the base side members is disposed generally perpendicular to the transverse base member; and wherein each of the base side members comprises a plurality of wheels coupled thereto, at least one of the plurality of wheels on each base side member being disposed rearwardly of the seat back portion of the mechanics chair so as to prevent the tipping thereof.

In yet a further embodiment, the generally vertical leg members are disposed generally perpendicular to the first and second of the plurality of base members and the first and second of the plurality of the seat members.

In still a further embodiment, the mechanics chair further comprises a pair of diagonal members, a first of the pair of the diagonal members coupling the first of the plurality of generally vertical leg members to the first of the plurality of seat members, and a second of the pair of the diagonal members coupling the second of the plurality of generally vertical leg members to the second of the plurality of seat members.

In yet a further embodiment, the seat portion further comprises a padded seat.

In still a further embodiment, the mechanics chair further comprises a pair of diagonal members, a first of the pair of the diagonal members coupling the first of the plurality of generally vertical leg members to the first of the plurality of seat members, and a second of the pair of the diagonal members coupling the second of the plurality of generally vertical leg members to the second of the plurality of seat members; and wherein the seat portion of the mechanics chair further comprises a padded seat.

In yet a further embodiment, the mechanics chair further comprises an attachment device coupled to the seat back portion of the mechanics chair. The attachment device including a first generally L-shaped member, the first generally L-shaped member including a head portion and a side portion, the head portion of the first generally L-shaped member having an end; a second generally L-shaped member, the second generally L-shaped member including a head portion and a side portion, the head portion of the second generally L-shaped member having an end; a connecting member, the connecting member slidably coupling the end of the head portion of the first generally L-shaped member to the end of the head portion of the second generally L-shaped member; and at one least pair of securement devices, a first of the at least one pair of securement devices attaching the side portion of the first generally L-shaped member to the first of the plurality of seat back members, and a second of the at least one pair of securement devices attaching the side portion of the second generally L-shaped member to the second of the plurality of seat back members.

In still a further embodiment, the mechanics chair further comprises an automotive creeper coupled to the seat back portion of the mechanics chair, the automotive creeper including a plurality of spaced apart, transverse frame members connected to first and second side members, the automotive creeper coupled to the seat back portion of the mechanics chair by means of at least one pair of laterally spaced apart hook members, a first of the at least one pair of hook members being attached to the first of the plurality of seat back members, and a second of the at least one pair of hook members being attached to the second of the plurality of seat back members.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
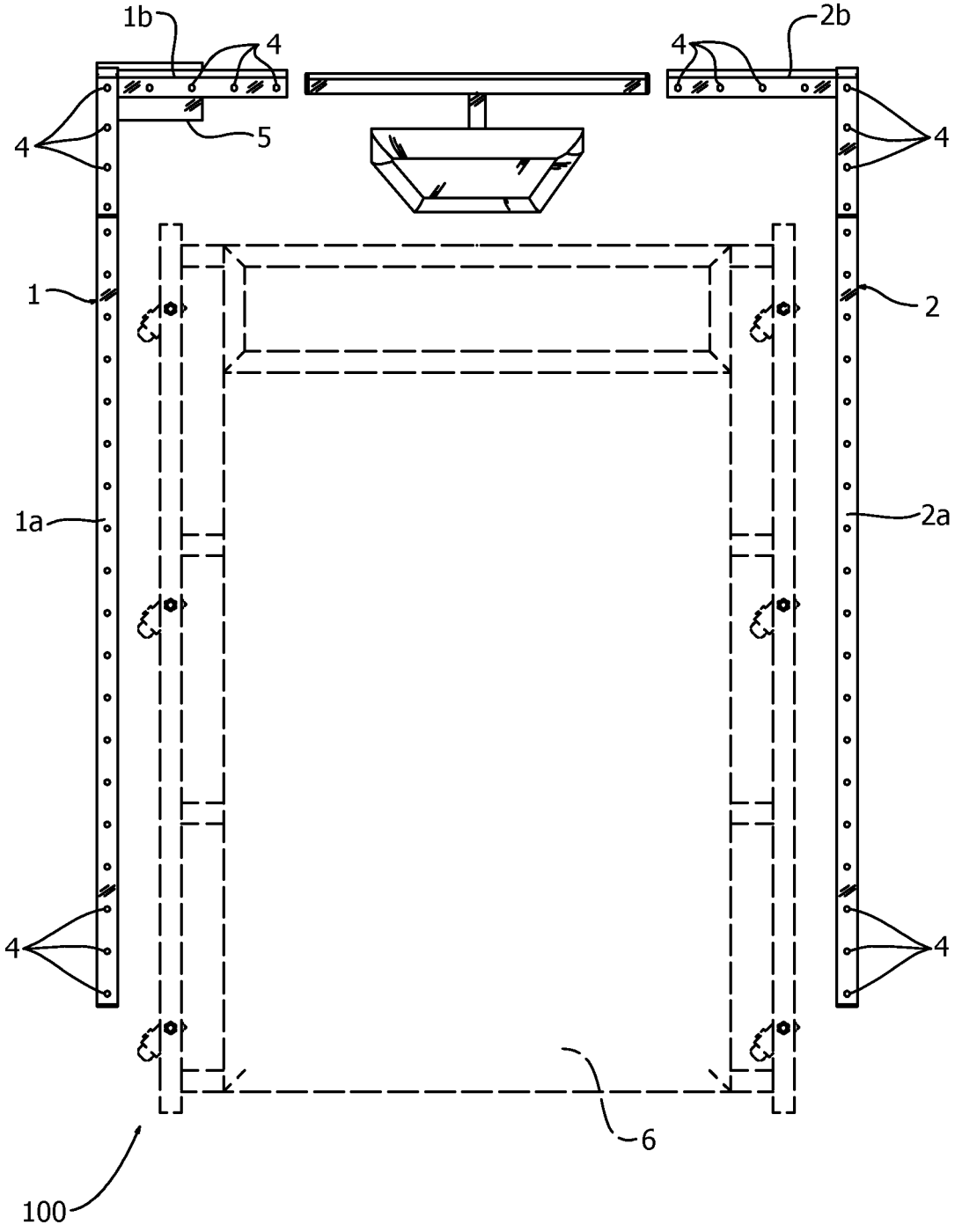
FIG. 1 is a top view of the attachment device disposed adjacent to an automotive creeper, according to an embodiment of the invention.

A first embodiment of the attachment device is seen generally at 100 in FIG. 1. As shown in this figure, the attachment device 100 is adapted to attach to an automotive creeper 6, which is illustrated in FIGS. 1-5 using dashed lines only to indicate that the attachment device 100 is capable of being attached to multiple creepers. The attachment device 100 generally comprises a first generally L-shaped member 1 (e.g., left side bar 1) and a second generally L-shaped member 2 (e.g., right side bar 2), both of which attach to respective sides of the creeper 6 by means of C-clamps. The two halves 1, 2 of the attachment device 100 connect together at a location 3 (see e.g., FIG. 2), which is in the form of an adjustable joint. The adjustable joint is designed to permit both members 1, 2 to slide in and out such that creepers having various widths may be readily accommodated. While many conventional creepers have a standard width of seventeen (17) inches, the adjustable joint of the attachment device 100 enables it to fit conventional creepers having widths that are larger and smaller than the standard seventeen (17) inch width.

In one embodiment, each of the generally L-shaped members 1, 2 is in the form of a tubular member having a generally square cross-section and a hollow core or interior. However, it is to be understood that other suitable cross-sectional shapes could be used for the generally L-shaped members 1, 2, such as rectangular or circular.

As shown in FIG. 1, the top of each generally L-shaped member 1, 2 may be provided with a plurality of light emitting devices 4 disposed along the length thereof. For example, the light emitting devices 4 may comprise small light-emitting diode (LED) type lamps that are inserted into the top surface of each generally L-shaped member 1, 2, and spaced apart along the entire length of each generally L-shaped member 1, 2. While individual LED lamps are depicted in the illustrated embodiment, it is to be understood that LED light strips could also be used. For added protection, the LED lights could be encased in metal holders or housings installed on each generally L-shaped member 1, 2. In addition, the light emitting devices 4 could be embodied in other forms as well, such as incandescent lamps, compact fluorescent lamps (CFLs), etc. Because the attachment device 100 accommodates lights directly thereon, it makes it possible for the mechanic to perform hands free service to the undercarriage or sides of an automobile without the hassle of holding a light. Preferably, the wiring for the light emitting devices 4 is run inside the hollow cavity of the generally L-shaped members 1, 2 (i.e., if the generally L-shaped members are provided in the form of tubular members). Because the light emitting devices 4 are mounted on the generally L-shaped members 1, 2, which are disposed around the periphery of the creeper 6, they are positioned out of the way, and not directly in the area where vehicle repairs are being performed. In addition, because the lights 4 of FIG. 1 extend generally the full length of each side of the creeper 6, and not just in the head area of the creeper 6, they are able to more fully illuminate the vehicle work area.

Advantageously, the light emitting devices 4 (e.g., bright LED lights) illuminate the area where the mechanic is working. As the mechanic moves the creeper, the lights will move with him. The entire work area is illuminated as opposed to a small area illuminated with conventional handheld lights. Energy efficiency can be greatly enhanced by using LED lights. For example, the LED lights use approximately 70% less energy than fluorescent or incandescent bulbs. Also, the LED lights have a longer bulb life. The LED lamps will burn for approximately 100,000+ hours, whereas fluorescent lamps last, for example, approximately 20,000+ hours. In addition, the LED lights operate cooler than other lamps. This is safer and particularly helpful in cramped spaces where the temperature can rise quickly. If and when it is needed, the LED lights are cheaper to repair/replace than buying a new lighting system. The LED lights can also be made to be water-resistant.

In the illustrated embodiment, the light emitting devices 4 are powered by a 12V rechargeable battery pack disposed in a battery container 5, and the lights 4 are turned "on" and "off" by an appropriate switch electrically coupled thereto. When needed, a standard power cord could be used to recharge the battery pack while it is attached to the creeper 6. Alternatively, or in addition to, non-stop work could be performed with extra battery packs charged and ready for quick replacement. Preferably, the battery pack is relatively compact and lightweight in construction so as not to significantly increase the overall weight of the creeper. In one embodiment, the battery container 5 is mounted behind the headrest so that it is out of the way, but those of ordinary skill in the art will appreciate that the battery container 5 could be mounted in various other suitable locations on the generally L-shaped members 1, 2 as well. Preferably, the battery container 5 will also include a 12V accessory jack provided thereon. This accessory jack could supply power to ultraviolet (UV) lights or to additional handheld lighting. For example, a six (6) inch, detachable handheld light could be attached with clips to the top of one of the generally L-shaped members 1, 2. If the need arises for the use of such additional or specialized UV lights, the accessory jack allows the mechanic to power the object without crawling out from under the vehicle to plug in the item. The 12V accessory jack could also power other items that use a 12V power source. For example, speakers could be added in the corners of the generally L-shaped members 1, 2. This would allow music or instructional recordings to be played while the mechanic is performing a repair. Preferably, the rechargeable battery pack powers the light emitting devices 4, the 12V accessory jack, and the optional, detachable handheld light.

Figure 2:
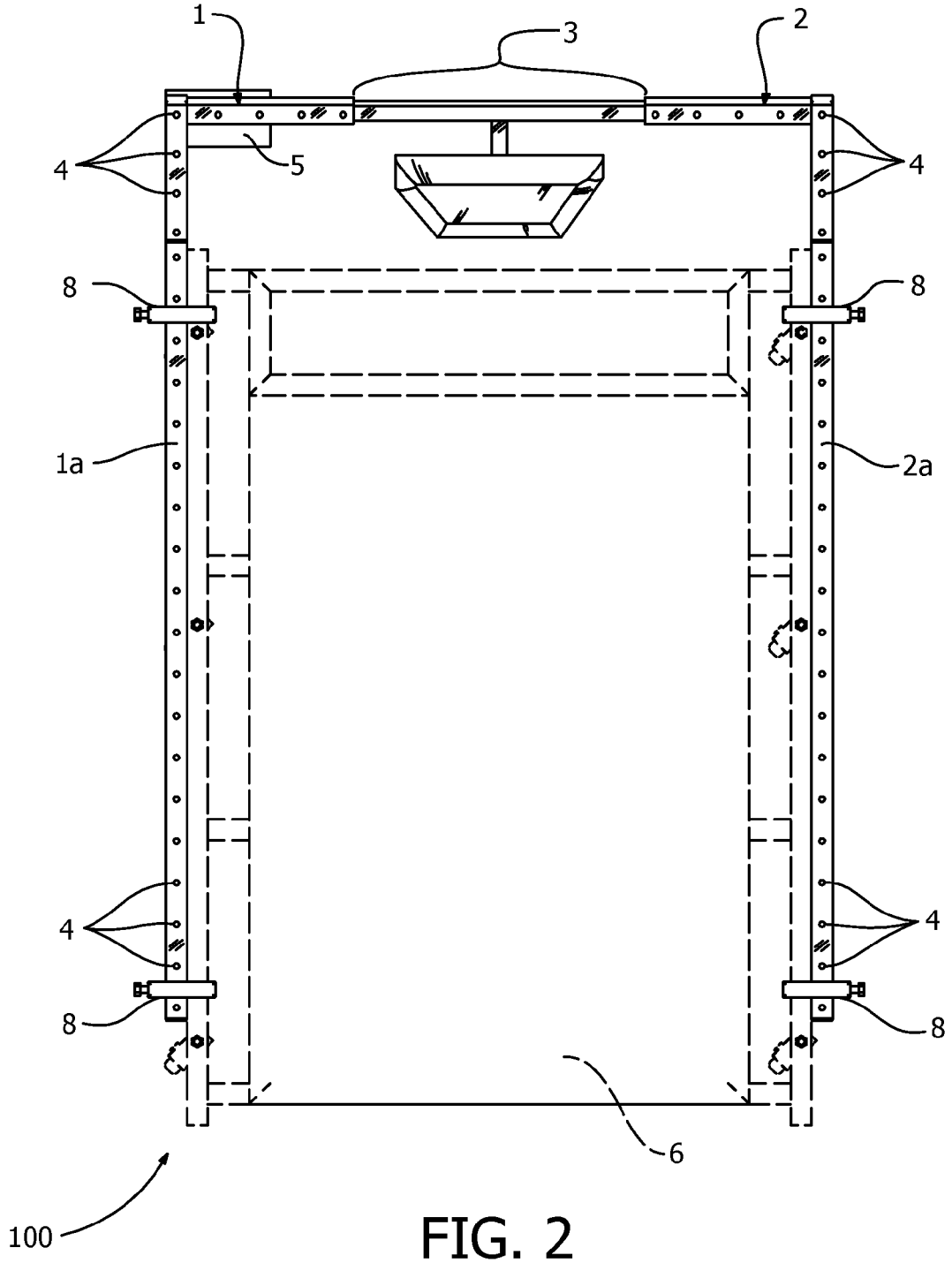
FIG. 2 is a top view of the attachment device attached to an automotive creeper, according to an embodiment of the invention.

In FIG. 2, the attachment device 100 is shown attached to an automotive creeper 6. In particular, both generally L-shaped members 1, 2 are attached together at the head end joint 3, and each generally L-shaped member 1, 2 is connected snuggly to a respective side (e.g., to a respective side rail or bar) of the automotive creeper 6 by means of a plurality of C-clamps 8. Preferably, when each generally L-shaped member 1, 2 is attached to a respective side bar of the automotive creeper 6, the top and bottom surfaces of each side bar portion 1*a*, 2*a* of each generally L-shaped member 1, 2 is disposed generally parallel to the respective top and bottom surfaces of each creeper side bar. In one embodiment, the head end joint 3 of the attachment device 100 is located proximate to and/or behind the headrest of the device 100. While each of the generally L-shaped members 1, 2 is connected to its respective side of the automotive creeper 6 by means of two C-clamps, it is to be understood that the invention is not so limited. Rather, more or less than two C-clamps could be used to secure each generally L-shaped member 1, 2 to its respective creeper side.

Figure 3:
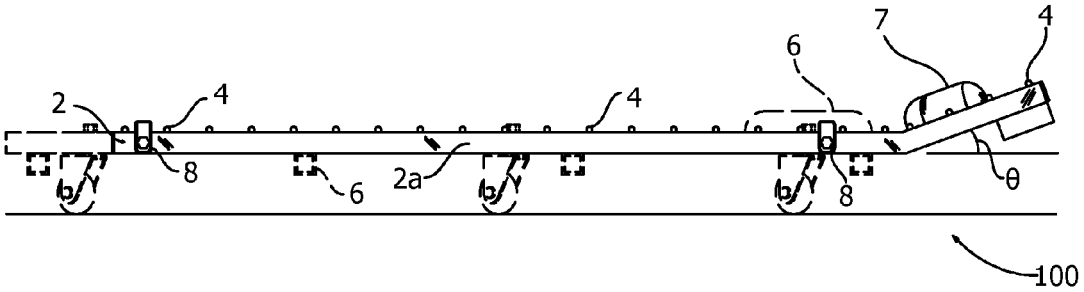
FIG. 3 is a right side view of the attachment device attached to an automotive creeper, according to an embodiment of the invention.

Now, referring to FIG. 3, the right generally L-shaped member 2 of the attachment device 100 is shown attached to an automotive creeper 6 with C-clamps 8. The illustrated embodiment of FIG. 3 also includes an additional headrest 7 (or head pad 7). Preferably, the head end of each side bar portion 1*a*, 2*a* of each generally L-shaped member 1, 2 is angled upward at an angle θ in the range of approximately 10 degrees to approximately 20 degrees, inclusive, or in range of 10 degrees to 20 degrees, inclusive (i.e., towards the head of a person lying on the creeper 6). In one embodiment, each generally L-shaped member 1, 2 is angled upward at an angle θ of approximately 20 degrees. Advantageously, this predetermined angle permits relaxed work periods without increased neck discomfort, and permits the light emitting devices 4 at the head end of the attachment device 100 (if provided therewith) to shine directly on the area or component of the vehicle that the mechanic is servicing. Also, the generally L-shaped members 1, 2 can be readily adjusted in a lengthwise direction of the creeper 6. In particular, the generally L-shaped members 1, 2 of the attachment device 100 can be slid forward or rearward relative to the creeper 6 (i.e., towards the head end or foot end of the creeper 6), and then, clamped in place using C-clamps 8. For example, sliding the generally L-shaped members 1, 2 of the attachment device 100 forward (i.e., towards the head end of the creeper 6) allows taller mechanics to use a creeper 6 which might otherwise be too short for them to work on comfortably. As such, a more custom fit for the mechanic can be readily obtained. The headrest 7 (or head pad 7) allows the mechanic to have head support, while reducing neck fatigue, when the generally L-shaped members 1, 2 are slid towards the head end of the creeper 6 and attached for accommodating a taller person. The headrest 7 of the attachment device 100 is particularly useful for conventional creepers that are not originally furnished with a headrest or head pad of any kind. While the C-clamps 8 may be used as one type of securement device for attaching the attachment device 100 to the creeper 6, it is to be understood that other types of securement devices may be used as well, such as hose clamps.

Figure 4:
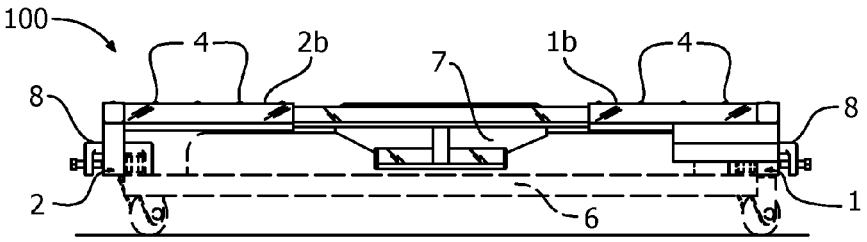
FIG. 4 is a head end view of the attachment device attached to an automotive creeper, according to an embodiment of the invention.

FIG. 4 illustrates a head end view of the attachment device 100 attached to an automotive creeper 6. Both generally L-shaped members 1, 2 are attached to each other at an adjustable joint 3 (see FIG. 2), and are each attached to the creeper 6 by means of C-clamps 8. The headrest 7 (or head pad 7) is coupled to the head portion 1*b*, 2*b* of each generally L-shaped member 1, 2. In the illustrated embodiment, a plurality of light emitting devices 4 (e.g., LED lamps) are spaced apart lengthwise along the top surface of each head portion 1*b*, 2*b* of each generally L-shaped member 1, 2. Although, in one or more alternative embodiments, some of the light emitting devices 4 (e.g., LED lamps) in the middle of the head end of the attachment device 100 may be replaced with a six (6) inch handheld, detachable light emitting device (e.g., a detachable LED light). Preferably, the detachable light emitting device will be fastened to the attachment device 100 with one or more clamps so that it can be removed and used when more light is needed in a certain area. Also, preferably, the light source will have constant power and will not need to be plugged into a building electrical receptacle (or electrical socket). As explained above, the light emitting devices 4 could be embodied in other forms as well, in addition to LED technology. Also, in one or more embodiments, the head end corner of each generally L-shaped member 1, 2 can have small speakers installed proximate thereto. As explained above with regard to FIG. 1, a small radio (e.g., a small AM/FM radio) could be used in conjunction with the attachment device 100. As another example of potential accessories for the attachment device 100, an iPod could be used with the device 100 if an iPod dock was added thereto. The aforementioned entertainment would be particularly beneficial if a mechanic is working underneath a vehicle for a long period of time. As previously explained, a mechanic could also play instructional recordings to assist him or her in performing a repair.

In one exemplary embodiment, the side bar portion 1*a*, 2*a* (side portion 1*a*, 2*a*) of each generally L-shaped member 1, 2 has a length of approximately forty (40) inches, while the head portion 1*b*, 2*b* of each generally L-shaped member 1, 2 has a length of between approximately eight (8) inches and approximately ten (10) inches. Although, one of ordinary skill in the art will appreciate that the invention is not so limited. Rather, other suitable lengths for the generally L-shaped members 1, 2 may be used without departing from the scope and spirit of the appended claims.

Figure 18:
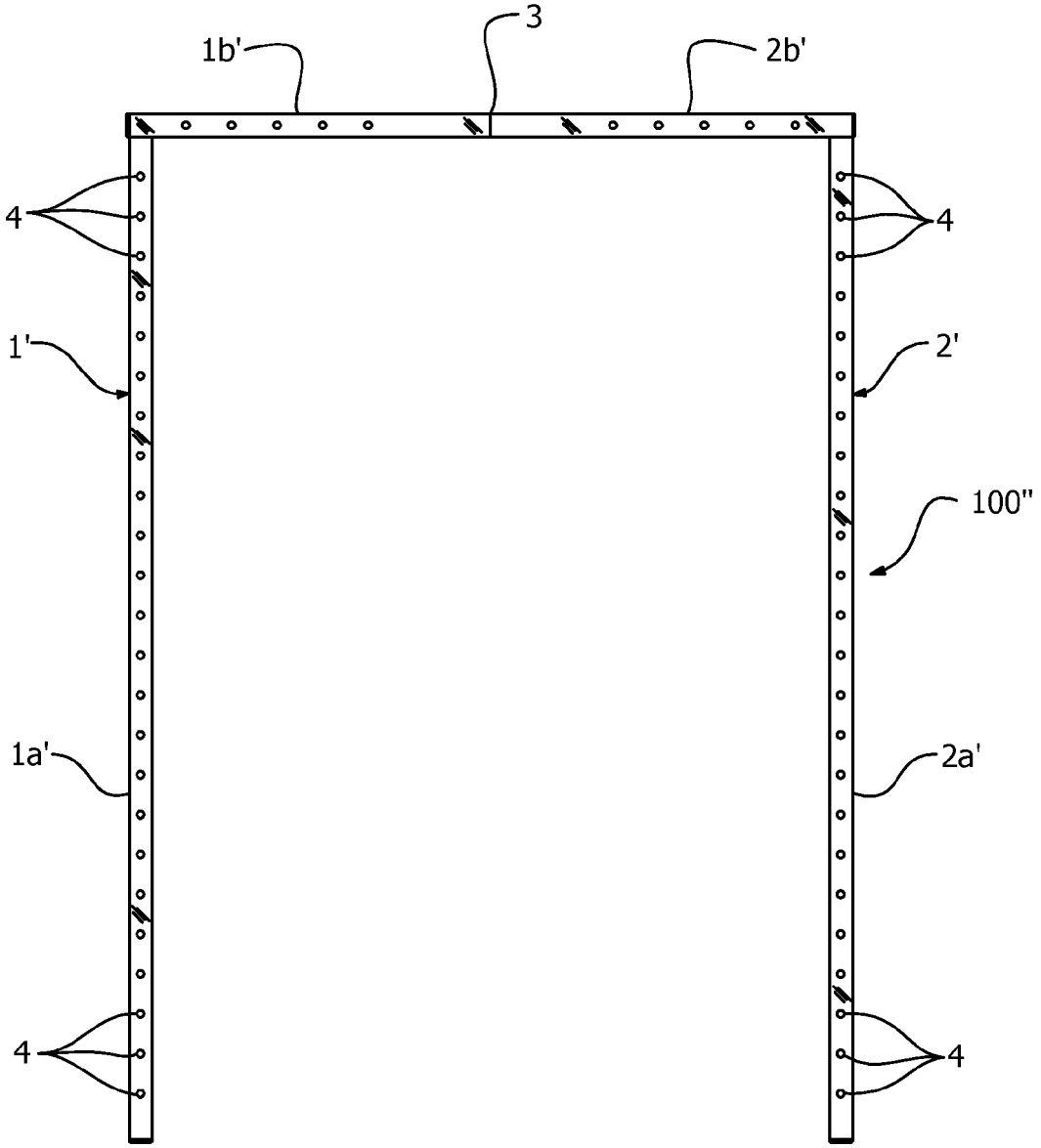
FIG. 18 is a perspective view of the two generally L-shaped members of the attachment device in an assembled state, according to an embodiment of the invention.
Figure 19:
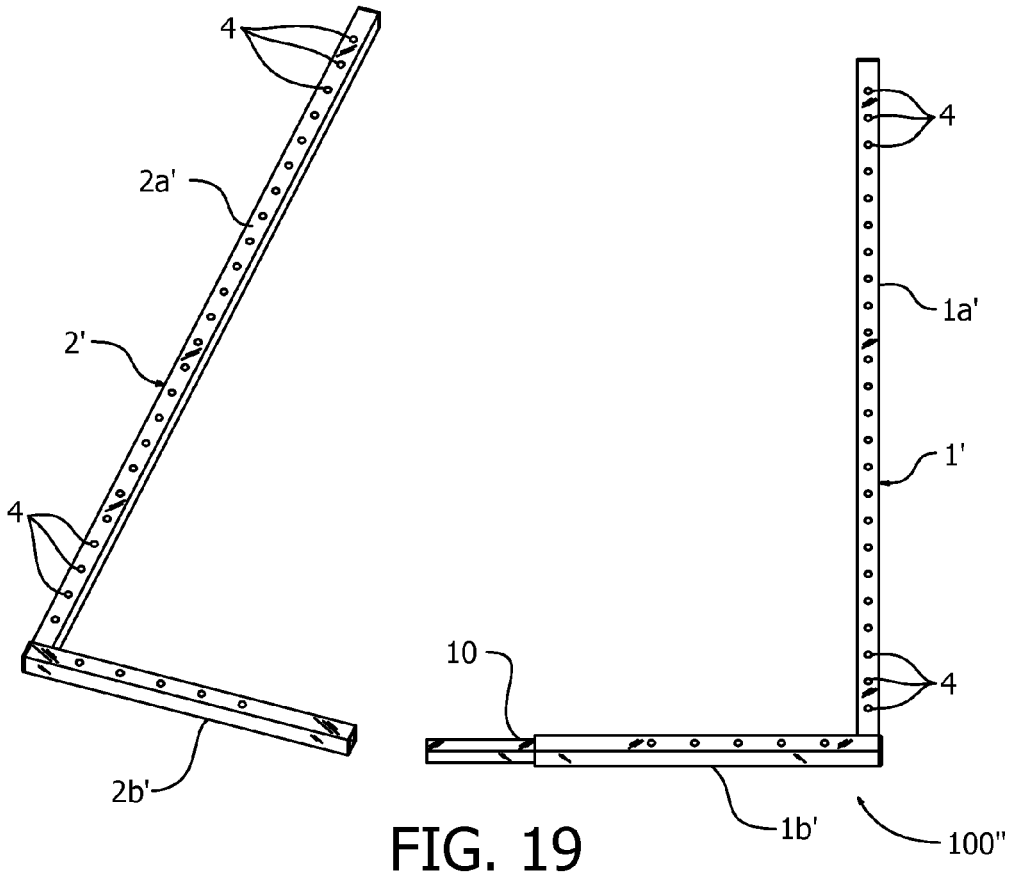
FIG. 19 is a perspective view of the two generally L-shaped members of the attachment device in an disassembled state, according to an embodiment of the invention.

FIG. 18 illustrates a modified version of the generally L-shaped members 1', 2' in an assembled state, whereas FIG. 19 illustrates the generally L-shaped members 1', 2' in a disassembled state so that one type of connecting member 10 (e.g., a generally straight tubular member of reduced cross-sectional area) is visible. Unlike the other embodiments of the attachment devices 100, 100', it can be seen that the side bar portions 1*a*', 2*a*' of the attachment device 100" of FIGS. 18 and 19 are generally straight without the head ends thereof being angled upwardly.

Figure 5:
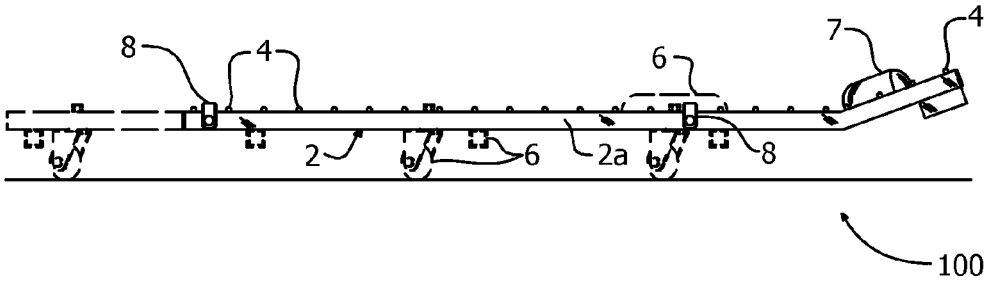
FIG. 5 is a right side view of the attachment device attached to an automotive creeper, according to an embodiment of the invention, wherein the attachment device is attached in an extended position so as to accommodate taller users of the creeper.

Referring now to FIG. 5, a right side view of the attachment device 100 attached to an automotive creeper 6 by means of C-clamps 8 is illustrated. This figure also depicts the additional headrest 7 (or head pad 7) of the attachment device 100. The head end of each side bar portion 1*a*, 2*a* of each generally L-shaped member 1, 2 is angled rearward (headward) at an angle of approximately 20 degrees. In FIG. 5, the attachment device 100 is installed further towards the head end of the automotive creeper 6. This enables taller mechanics to utilize a creeper 6 that may otherwise be too short for them to work on comfortably. Also, the headrest 7 (or head pad 7) allows the mechanic to have head support when the generally L-shaped members 1, 2 of the attachment device 100 are slid towards the head end of the creeper 6, and attached thereto for a taller person.

Figure 17:
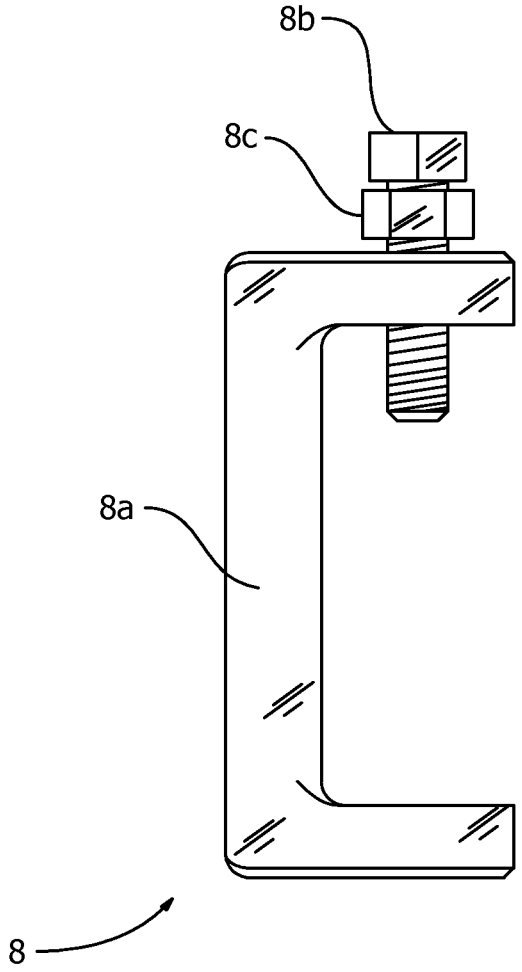
FIG. 17 is a frontal perspective view of a C-clamp, which is used for securing the attachment device to the automotive creeper and/or mechanics chair, according to an embodiment of the invention.

With reference to FIG. 17, an embodiment of a C-clamp 8 used in conjunction with the attachment device 100 is shown. It can be seen that the C-clamp 8 comprises a generally C-shaped body portion 8*a*, a bolt 8*b* threadingly received within an aperture of the generally C-shaped body portion 8*a*, and a nut 8*c* threadingly coupled to the bolt 8*b*. One or more C-clamps 8 are used to secure the attachment device 100 to an automotive creeper 6 and/or the mechanics chair described hereinafter.

Figure 8:
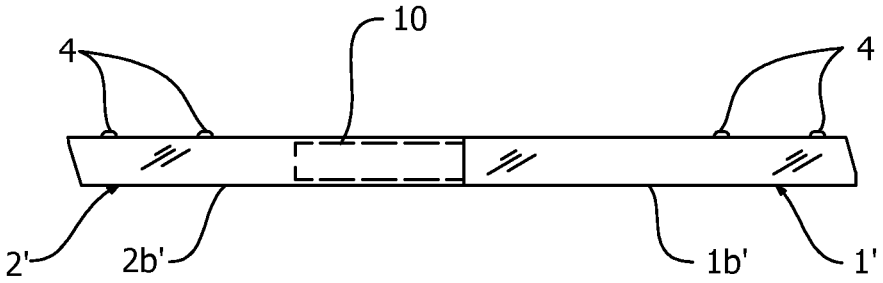
FIG. 8 is an enlarged view illustrating a first coupling means for the two generally L-shaped members which form the attachment device, according to an embodiment of the invention.

An enlarged view illustrating a first coupling means (connecting member) for the two generally L-shaped members 1', 2' of the attachment device 100" is illustrated in FIG. 8. In particular, the end of the head portion 1*b*' of the first generally L-shaped member 1' is provided with the generally straight tubular member 10, which has a smaller cross-section area, affixed thereto (also see FIG. 19). In one exemplary embodiment, the generally L-shaped members 1', 2' each have a cross-sectional area of approximately one (1) inch by one (1) inch, whereas the tubular member 10 has a cross-sectional area of approximately three-quarters (¾) of an inch by three-quarters (¾) of an inch. In a preferred embodiment, the smaller tubular member 10 is welded to the end of the head portion 1*b*' of the first generally L-shaped member 1'. As shown in FIG. 8, the smaller tubular member 10 is slidably received within the head portion 2*b*' of the second generally L-shaped member 2'. Because the end of the first generally L-shaped member 1' is capable of sliding back-and-forth within the end portion of the second generally L-shaped member 2', the attachment device 100" is capable of being adjusted so as to accommodate automotive creepers 6 having variable widths.

Figure 10:
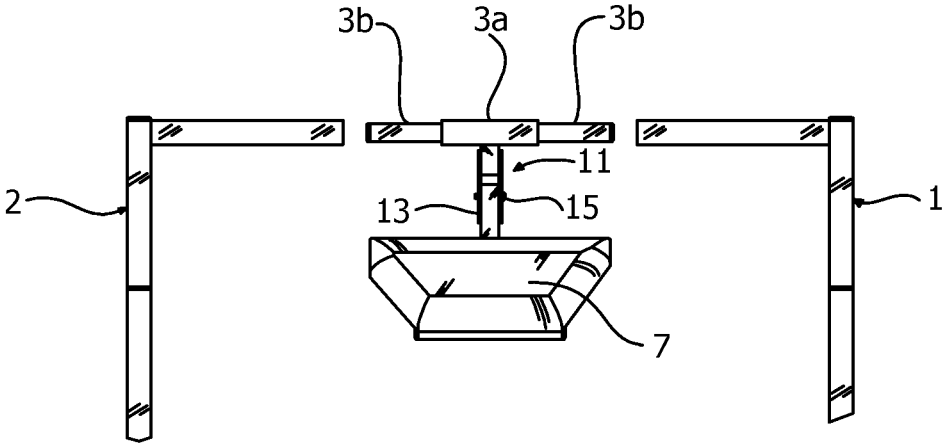
FIG. 10 is an enlarged view illustrating a second coupling means for the two generally L-shaped members which form the attachment device, according to an embodiment of the invention.

Referring now to FIG. 10, an enlarged view of a second coupling means (connecting member) for the two generally L-shaped members 1, 2 is shown. The second coupling means for the two generally L-shaped members 1, 2 comprises a generally T-shaped member with opposed end portions 3*b* having reduced cross-sectional areas so as to enable the end portions 3*b* to be inserted into the ends of the generally L-shaped members 1, 2. As shown in FIG. 10, the generally T-shaped member is part of a T-bar system 3*a*, which includes mounting means for the headrest 7 (or head pad 7). In this embodiment, the headrest 7 can also be adjusted further up and down with the movable connection 11 (pivotable connection 11), and then locked in place with a pin 15. In one exemplary embodiment, a majority of the generally T-shaped member has a cross-sectional area of approximately one (1) inch by one (1) inch, except for the opposed end portions 3*b* of reduced cross-sectional area, which have a cross-sectional area of approximately three-quarters (¾) of an inch by three-quarters (¾) of an inch.

Figure 15:
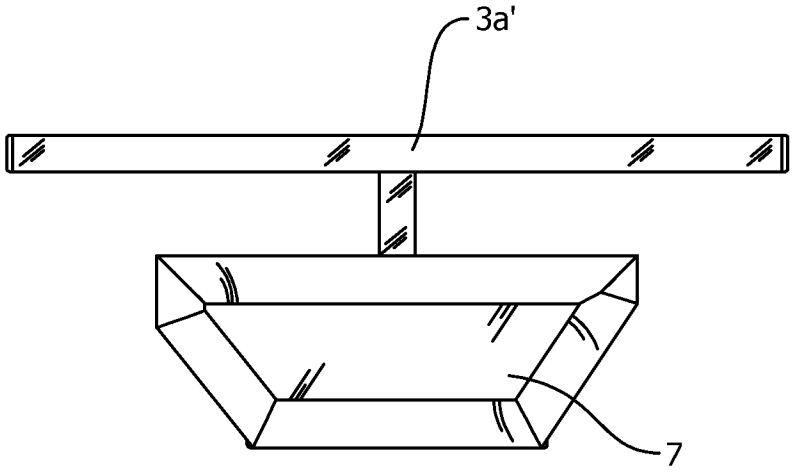
FIG. 15 is an enlarged front view illustrating a modified second coupling means for the two generally L-shaped members, according to an embodiment of the invention.
Figure 16:
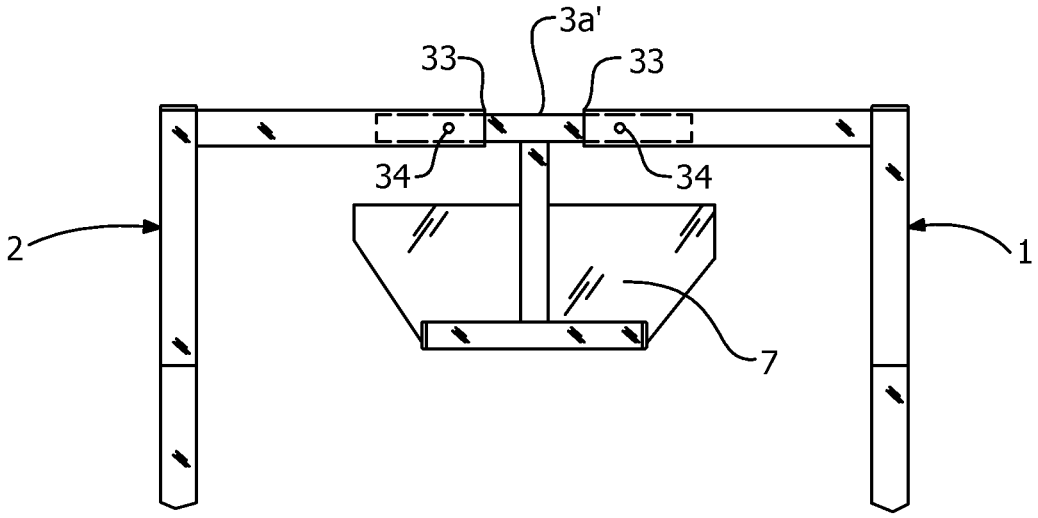
FIG. 16 is an enlarged rear view illustrating the modified second coupling means for the two generally L-shaped members, according to an embodiment of the invention, wherein the alternative second coupling means is shown connecting the two generally L-shaped members together.

A modified version of the second coupling means (connecting member) for the two generally L-shaped members 1, 2 is depicted in FIGS. 15 and 16. In most respects, the modified T-bar system 3*a*' of FIGS. 15 and 16 is generally the same as the T-bar system 3*a* of FIG. 10. However, unlike the T-bar system 3*a*, the modified T-bar system 3*a*' does not have opposed end portions 3*b* with reduced cross-sectional areas. Rather as shown in FIGS. 15 and 16, the generally T-shaped member has a substantially uniform cross-sectional area throughout. In one exemplary embodiment, the generally T-shaped member of FIGS. 15 and 16 has a cross-sectional area of approximately three-quarters (¾) of an inch by three-quarters (¾) of an inch throughout so that it is capable of being inserted into the open ends of the generally L-shaped members 1, 2, which can have a cross-sectional area of approximately one (1) inch by one (1) inch.

As shown in FIGS. 15 and 16, the headrest 7 (or head pad 7) is supported by the T-bar system 3*a*'. In particular, the headrest 7 is attached to the base of the generally T-shaped member of the T-bar system 3*a*'. Referring to FIG. 16, it can be seen that the opposed ends of the generally T-shaped member are inserted into the open ends 33 of each generally L-shaped member 1, 2. The position of each generally L-shaped member 1, 2 can be slidably adjusted relative to the generally T-shaped member so as to permit the attachment device 100 to accommodate automotive creepers of various widths. Once each generally L-shaped member 1, 2 has been adjusted to its desired position, it can be secured in place by tightening the fasteners 34 (e.g., bolts) against the outer surface of the generally T-shaped member. In one exemplary embodiment, the inner width of the attachment device 100 (i.e., the distance between the inner side of each side bar portion 1*a*, 2*a*) is adjustable in the range between approximately seventeen (17) inches and approximately twenty-four (24) inches (or between 17 and 24 inches). Advantageously, this enables the attachment device 100 to be used with a vast majority of the automotive creepers on the market today.

Figure 11:
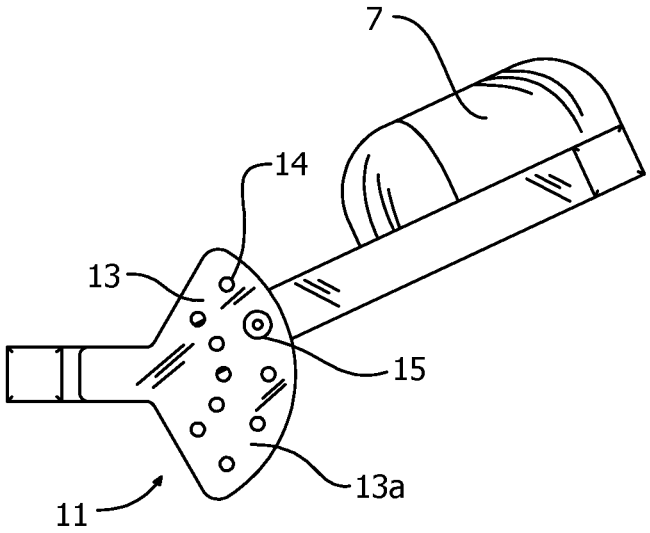
FIG. 11 is an enlarged view illustrating an optional hinge joint for adjusting the angle of the headrest portion of the attachment device, according to an embodiment of the invention.

In FIG. 11, an enlarged view of an optional hinge joint for adjusting the angle of the headrest portion 7 of the attachment device 100 is depicted. In particular, the adjustable hinge 13 allows the headrest 7 (or head pad 7) to be adjusted further up and down while attached to both generally L-shaped members 1, 2. As shown in FIG. 11, the adjustable hinge 13 comprises a semi-circular end portion 13*a* with a plurality of spaced apart apertures 14 disposed therein. A pin or detent 15 engages with one of the spaced apart apertures 14 in the semi-circular end portion 13*a* in order to lock the angular position of the headrest 7.

Figure 12:
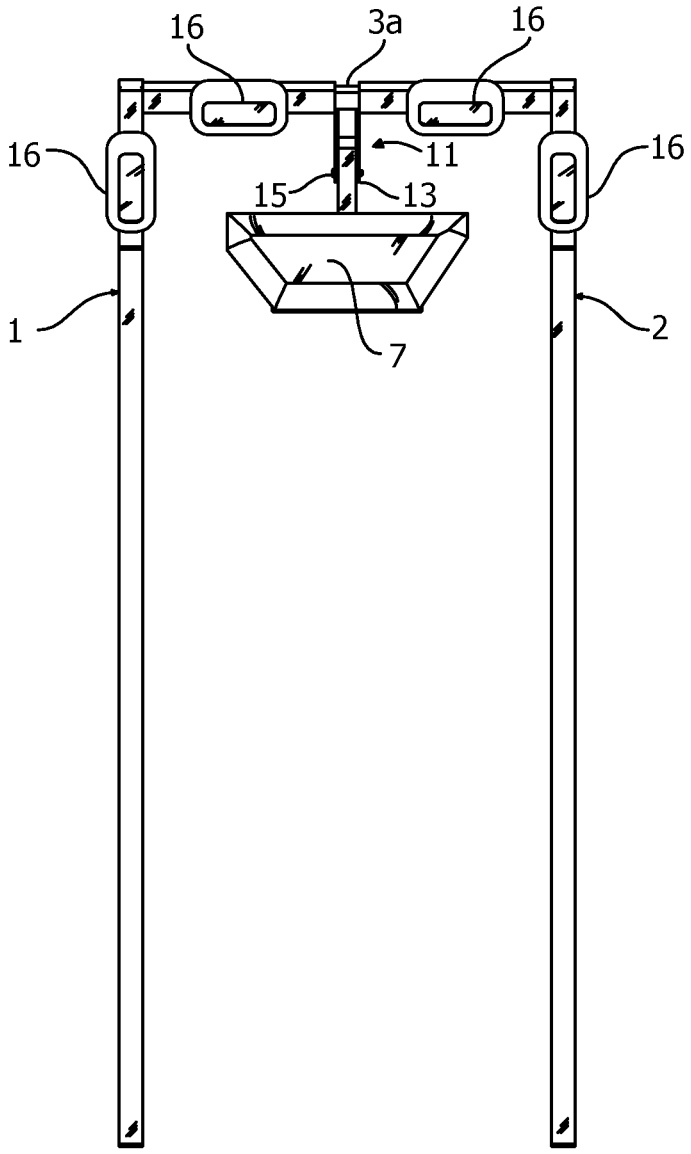
FIG. 12 is a frontal view of the attachment device illustrating one variation of the headrest portion and removable light emitting devices, according to an embodiment of the invention.

Now, with reference to FIG. 12, a frontal (top) view of the generally L-shaped members 1, 2 coupled together by means of the T-bar system 3*a* is illustrated. As explained above with regard to FIG. 10, the adjustment joint 11 enables the angular position of the headrest 7 to be selectively adjusted. In FIG. 12, it can also be seen that each of the generally L-shaped members 1, 2 are provided with a plurality of removable light emitting devices 16 near the headrest 7 (e.g., each generally L-shaped member 1, 2 is provided with two (2) removable light emitting devices 16 disposed on the top surface thereof). In a preferred embodiment, the removable light emitting devices 16 comprise removable, magnetically-attached LED lights that can be selectively positioned on each of the generally L-shaped members 1, 2. Preferably, each of the generally L-shaped members 1, 2 is formed from a metallic material (e.g., a lightweight, but strong steel), so that the magnet(s) on the back of each LED light is readily attracted to the outer surfaces of the members 1, 2.

Figure 20:
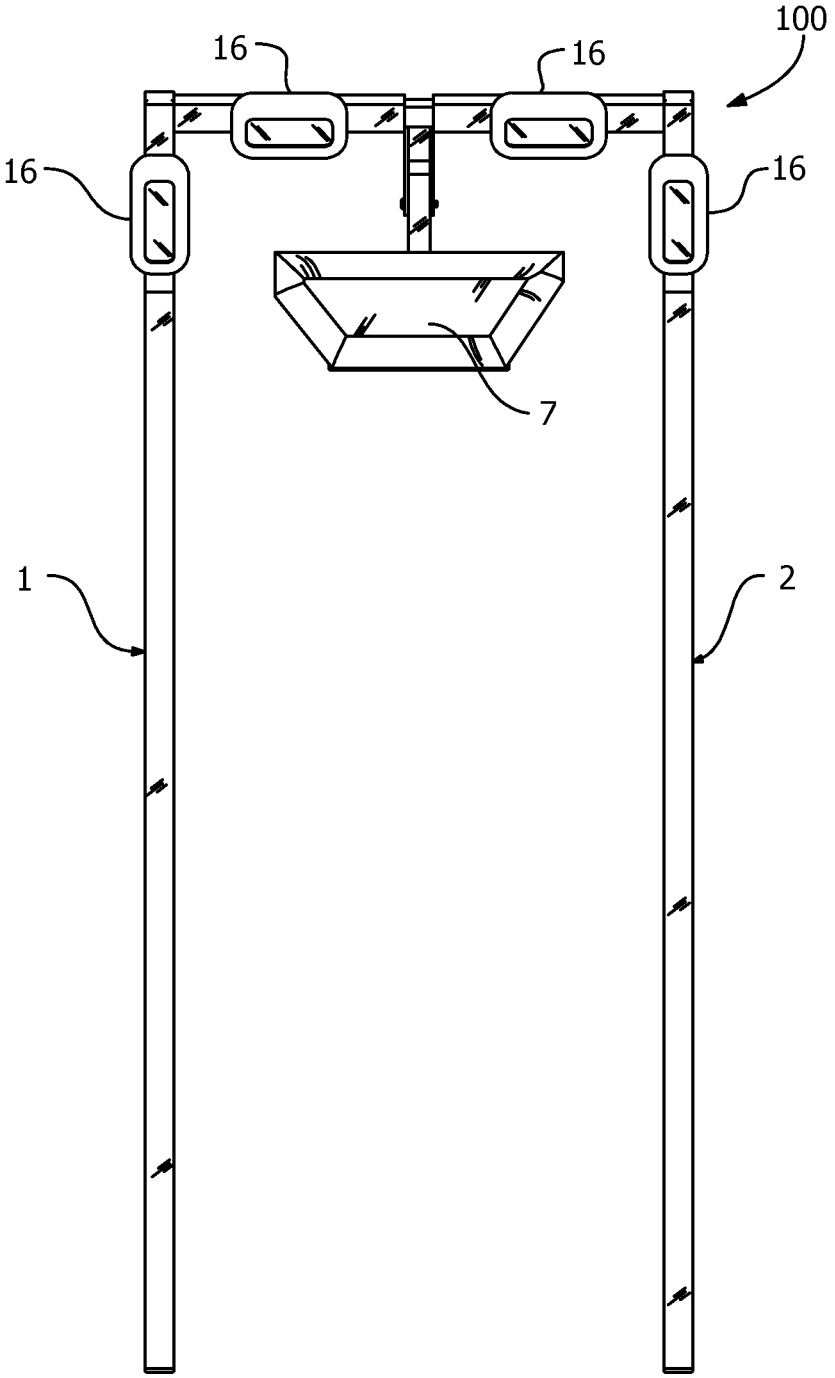
FIG. 20 is a top plan view of the attachment device, according to an embodiment of the invention, wherein the attachment device includes a headrest and a plurality of removable light emitting devices.
Figure 21:
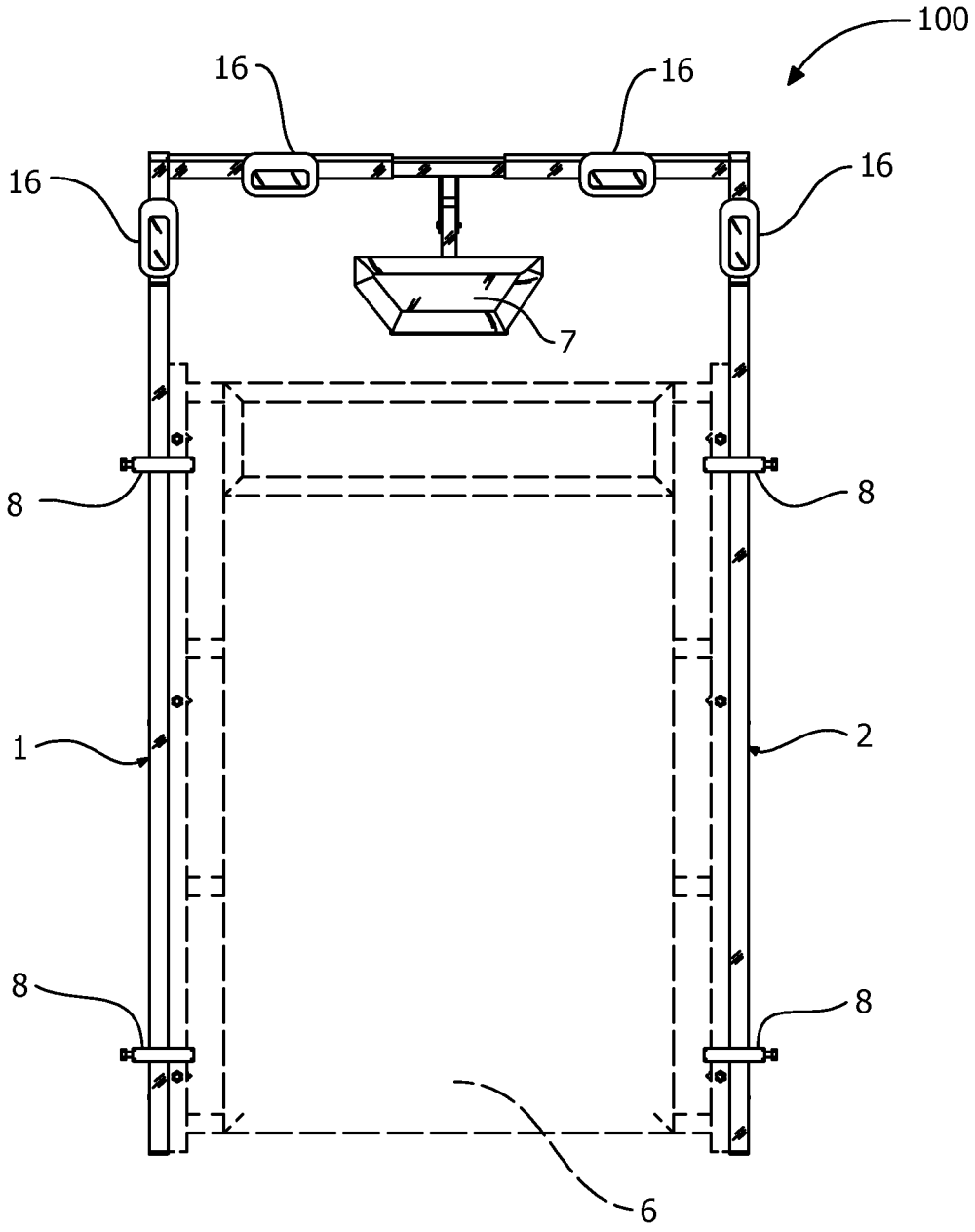
FIG. 21 is one top plan view of the attachment device attached to an automotive creeper, according to an embodiment of the invention, wherein the attachment device includes a headrest and a plurality of removable light emitting devices.
Figure 22:
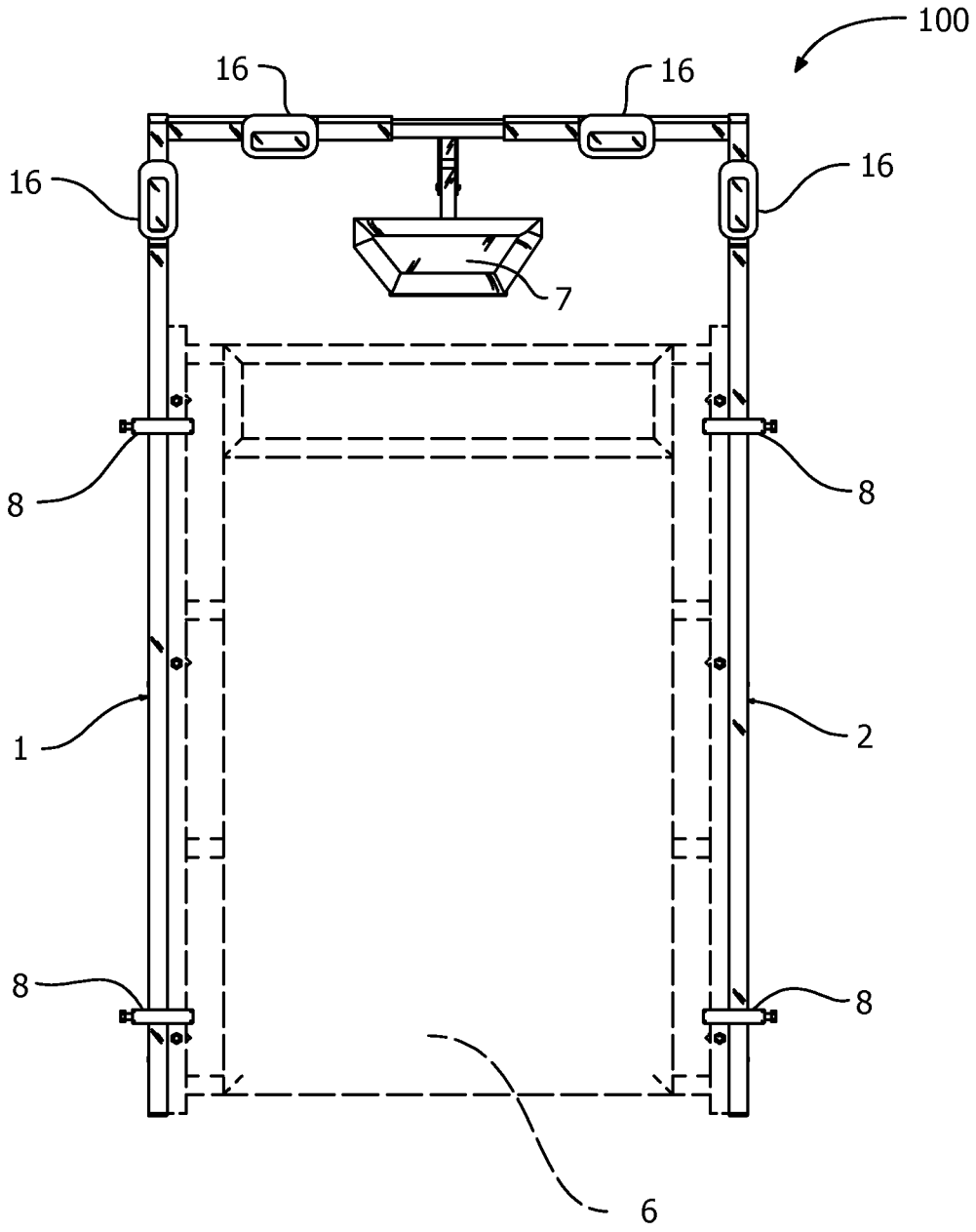
FIG. 22 is another top plan view of the attachment device attached to an automotive creeper, according to an embodiment of the invention, wherein the attachment device includes a headrest and a plurality of removable light emitting devices.
Figure 23:
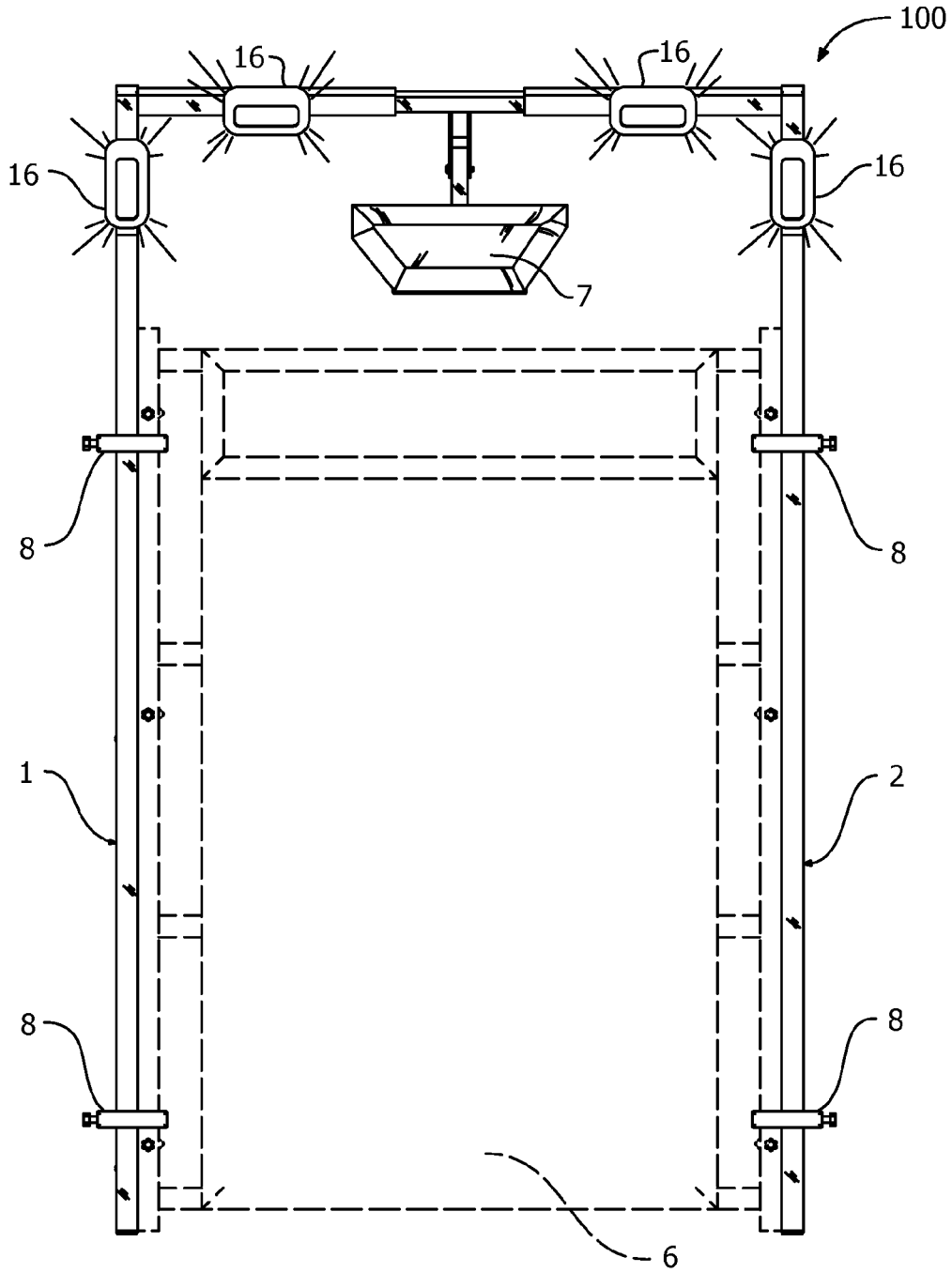
FIG. 23 is yet another top plan view of the attachment device attached to an automotive creeper, according to an embodiment of the invention, wherein the attachment device includes a headrest and a plurality of removable light emitting devices that are turned "on"

The attachment device 100 of FIG. 20 is shown attached to an automotive creeper 6 in FIGS. 21-23 by means of C-clamps 8. In FIG. 23, the removable light emitting devices 16 are turned "on" in order to generally illustrate the functionality of these lights 16. These light emitting devices 16 can produce enough light to sufficiently illuminate the undercarriage of vehicle while it is being serviced.

Figure 13:
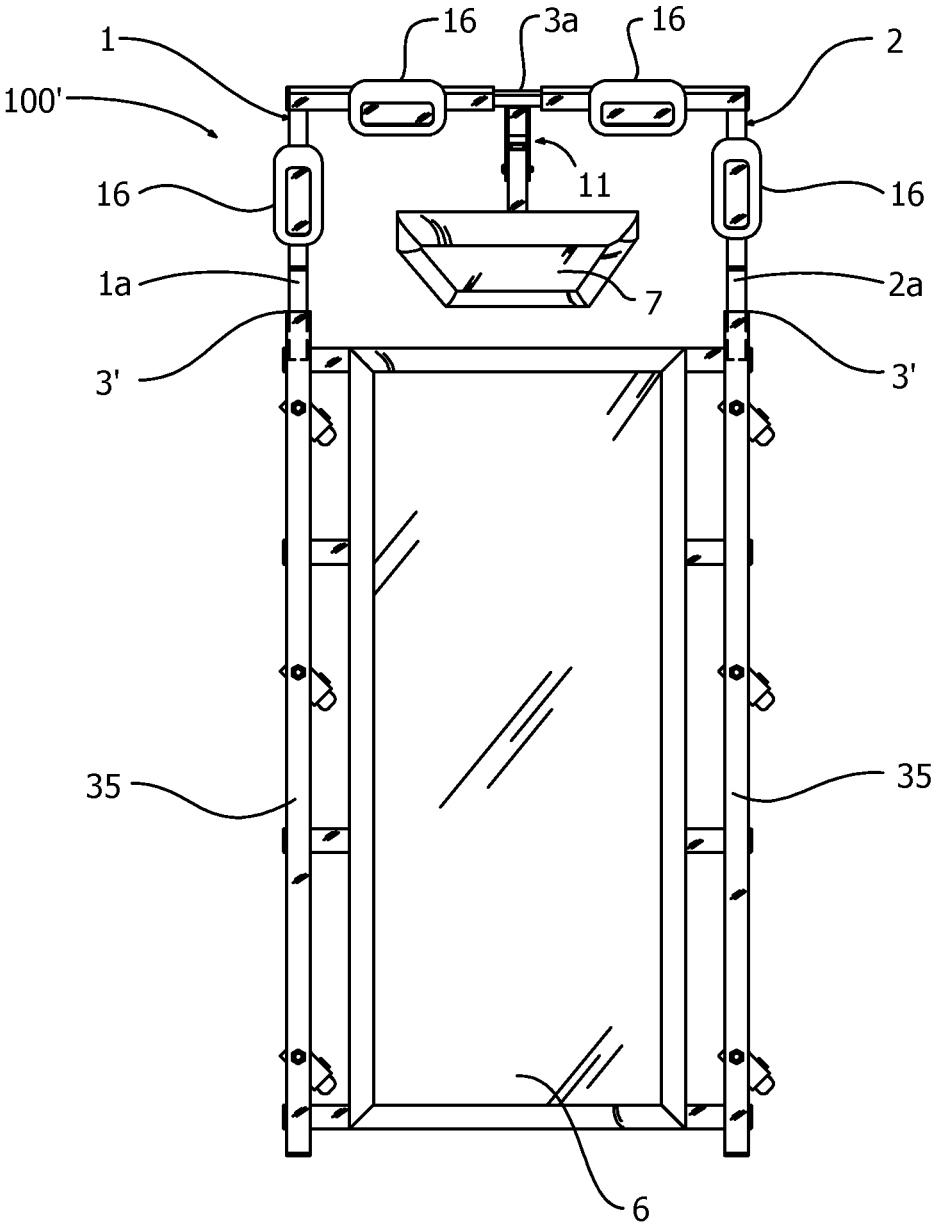
FIG. 13 is a top view of an alternative attachment device attached to an automotive creeper, according to an embodiment of the invention.
Figure 14:
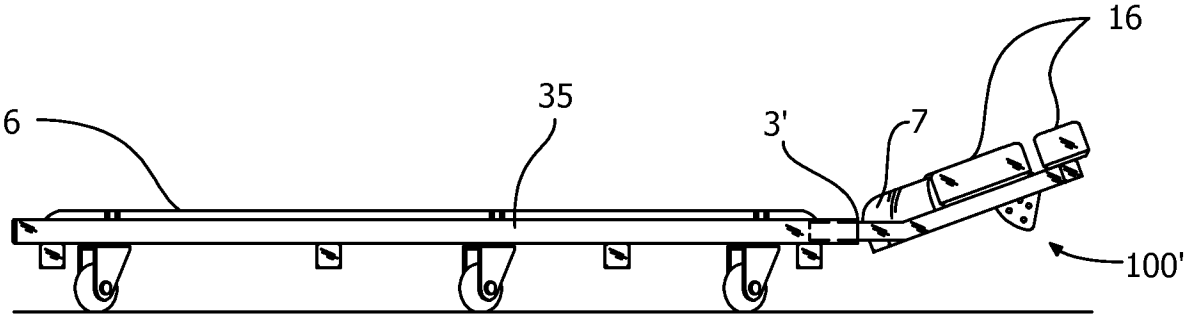
FIG. 14 is a right side view of the alternative attachment device attached to an automotive creeper, according to an embodiment of the invention.

Another embodiment of the attachment device is shown in FIGS. 13 and 14. The attachment device 100' of FIGS. 13 and 14 attaches to the automotive creeper 6 in a different manner than that which was previously described for the attachment device 100. In particular, rather than attaching the generally L-shaped members 1, 2 to the automotive creeper 6 using C-clamps 8, the end of each side bar portion 1*a*, 2*a* of each generally L-shaped member 1, 2 slips into a respective side tubular member 35 of the automotive creeper 6 (see e.g., FIG. 14). As such, there is an adjustable side joint 3' on each side of the creeper 6. The length of each side bar portion 1*a*, 2*a* of each generally L-shaped member 1, 2 protruding from the head end of the automotive creeper 6 can be selectively adjusted by a user, and then secured in place by using suitable securement means (e.g., respective fasteners engaging the outer surfaces of the side bar portions 1*a*, 2*a*). Similar to the previously described embodiments of the attachment device 100, the attachment device 100' includes a T-bar system 3*a* with a headrest 7 adjustably mounted thereto (refer to FIG. 13). The angle at which the headrest is disposed can be adjusted by means of the adjustment joint 11. Also, similar to the aforedescribed embodiments of the attachment device 100, the generally L-shaped members 1, 2 are each provided with a plurality of removable light emitting devices 16 disposed thereon.

In some embodiments, the attachment device 100 is in the form of an add-on, self-contained, rechargeable lighting system, which fits most of the automotive creepers on the market today. The attachment device 100 could also fit future creeper models. In particular, the attachment device 100 is an add-on item for people who already own a creeper. Therefore, the person does not have to replace his or her current creeper. If the person's creeper needs replaced, this unit can be easily removed and attached to the replacement creeper. The attachment device 100 can also be added to new creepers and sold as a complete unit.

It is readily apparent that the aforedescribed attachment device 100, 100', 100" offers numerous advantages. For example, the attachment device 100, 100', 100" is very easy to attach to an automotive creeper and can be done so in less than 5 minutes. Also, the attachment device 100, 100', 100" can be secured to an automotive creeper without drilling any holes into the creeper components, thereby maintaining the structural integrity of the creeper. The attachment device 100, 100', 100" described herein is relatively slender and unobtrusive so as not inhibit the ability of the creeper to be moved around in tight areas. The attachment device 100, 100', 100" allows the work on vehicles to be performed in a safer and easier manner by providing hands-free light and/or better head support for the mechanic. As a result, accidents and time lost from work could be substantially reduced due to fewer injuries during vehicle repair. In addition, the useful life of existing equipment could be extended by obviating the need to replacement existing creepers that are in good working condition.

Figure 6:
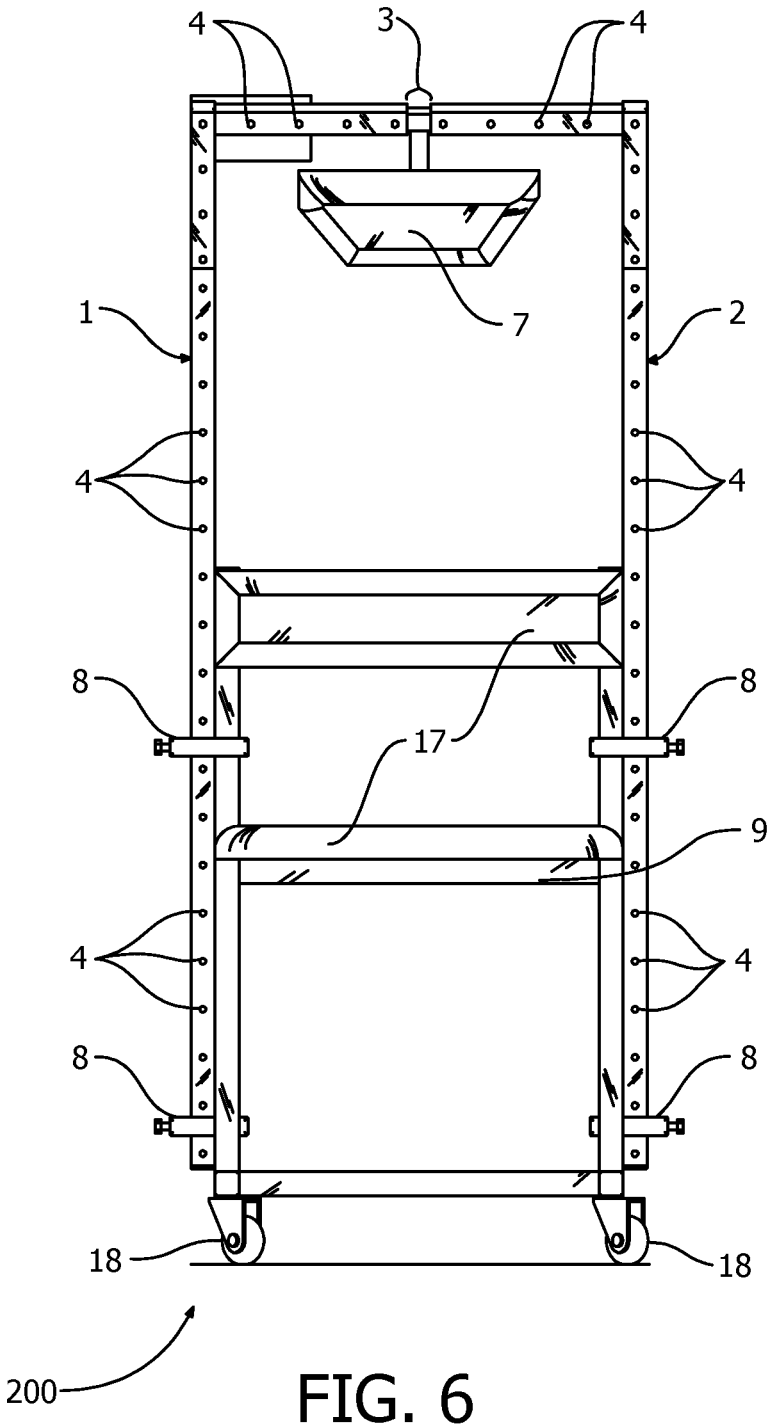
FIG. 6 is a frontal view of a mechanics chair with the attachment device attached thereto, according to an embodiment of the invention, wherein the attachment device is in a first position.

Now, with reference to FIGS. 6, 7, 9, and 24-26, the mechanics chair assembly 200 will be described in detail. In FIG. 6, a front view of the mechanics chair assembly 200 is shown with the generally L-shaped members 1, 2 attached to the mechanics chair 9. As illustrated in this figure, a plurality of light emitting devices 4 are spaced apart along substantially the entire length of each generally L-shaped member 1, 2. Also, the headrest 7 (or head pad 7) is shown attached to the generally L-shaped members 1, 2 in FIG. 6. In addition, in FIG. 6, it can be seen that the mechanics chair is preferably provided with one or more pads 17 (e.g., vinyl pads) so as to facilitate the comfort of the individual sitting thereon. The mechanics chair 9 is also preferably provided with a plurality of wheels 18 pivotally mounted thereto in order to enhance the portability of the mechanics chair.

Figure 7:
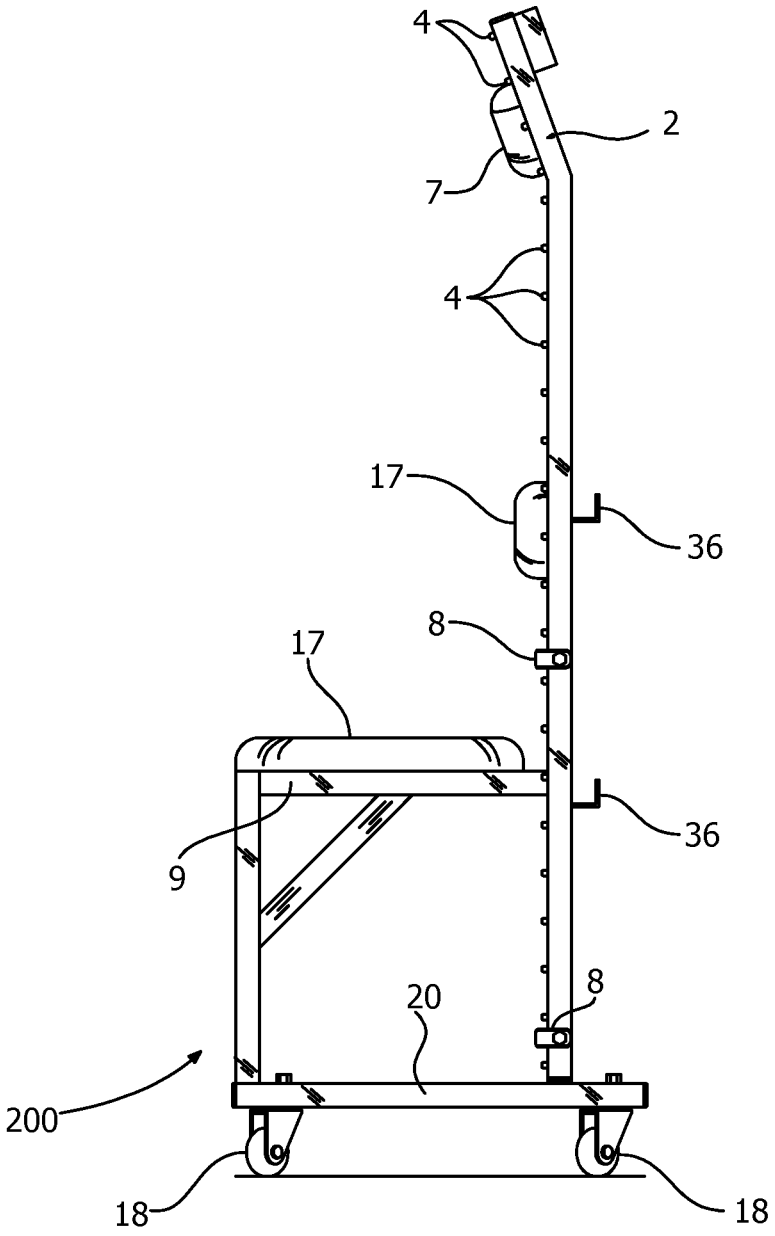
FIG. 7 is a left side view of the mechanics chair with the attachment device attached thereto, according to an embodiment of the invention.

In the side view of FIG. 7, it can be seen that the generally L-shaped members 1, 2 are attached to the mechanics chair 9 using the same C-clamps 8 described above with regard to the attachment device 100. Advantageously, the attachment device 100 can be used interchangeably with the automotive creeper 6 and the mechanics chair 9. Thus, there is not a need to purchase two separate attachment devices 100. Rather, the attachment device 100 can be simply transferred from the automotive creeper 6 to the mechanics chair 9, and vice versa, as required.

Figure 9:
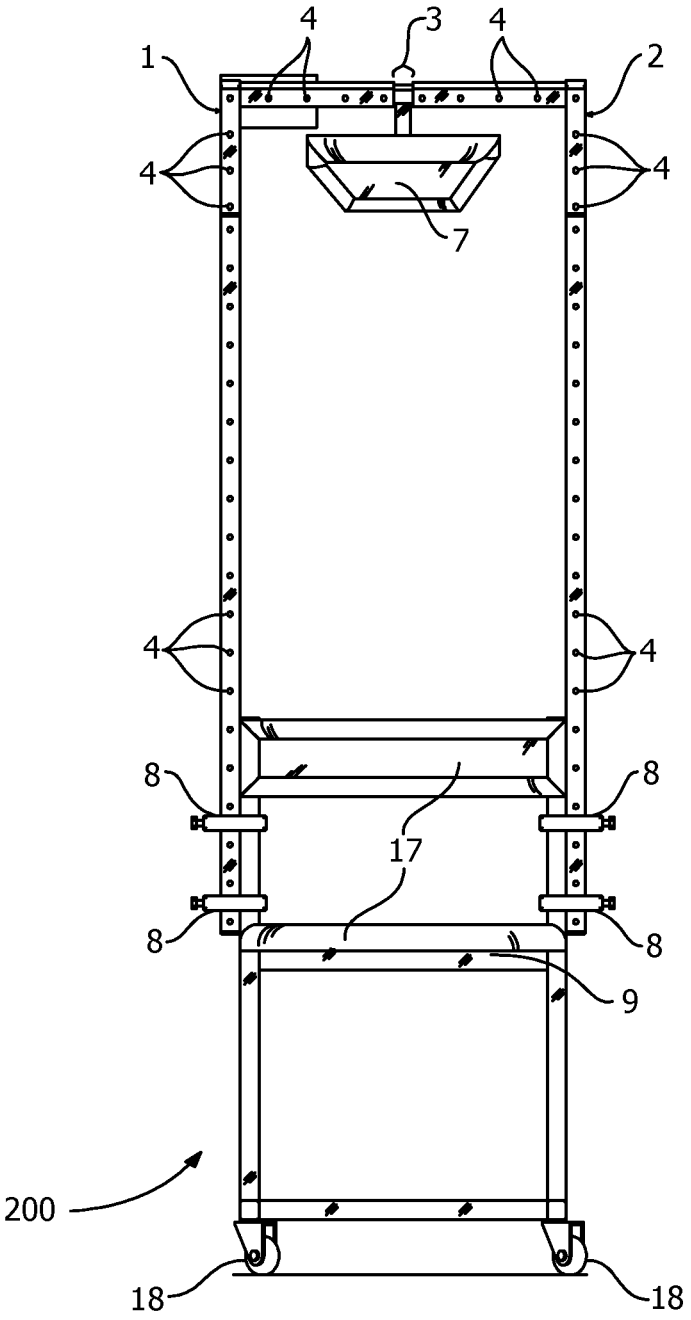
FIG. 9 is a frontal view of the mechanics chair with the attachment device attached thereto, according to an embodiment of the invention, wherein the attachment device is in a second raised position.

In FIG. 9, another front view of the mechanics chair assembly 200 is shown with the generally L-shaped members 1, 2 attached to the mechanics chair 9. In this view, it can be seen that the generally L-shaped members 1, 2 are preferably attached to the structure of the mechanics chair 9 using a plurality of C-clamps 8 on opposite sides thereof. While two (2) C-clamps 8 are used on each side of the mechanics chair 9 in the illustrated embodiment, it is to be understood that the invention is not so limited. Rather, more or less than two C-clamps could be used to secure each generally L-shaped members 1, 2 to its respective side of the mechanics chair 9.

Next, the structural frame of the mechanics chair 9 will be explained in detail with reference to FIG. 24. As shown in this figure, the base of the frame of the mechanics chair assembly 200 is generally rectangular in shape, and includes a first base side member 19 and a second base side member 20, which is spaced apart from the first base side member 19 by the length of the transverse base members 21. The first and second base side members 19, 20 are disposed generally parallel to one another, while the transverse base members 21 are disposed generally perpendicular to each of the first and second base side members 19, 20. As best illustrated in the side view of FIG. 7, it can be seen that the first and second base side members 19, 20 extend beyond the seat frame structure disposed thereabove in order to enhance the stability of the mechanics chair assembly 200. Referring again to FIG. 24, the seat structure of the mechanics chair 9 comprises first and second seat side members 22, 23, which are spaced apart from one another by the length of two transverse seat members 24, 25. The first and second seat side members 22, 23 are disposed generally parallel to one another, while each of the two transverse seat members 24, 25 are disposed generally perpendicular to each of the two seat side members 22, 23. The first transverse seat member 24 is disposed in the front of the seat, while the second transverse seat member 25 is disposed near the rear of the seat. In order to increase the chair strength when the weight of an individual is applied to the seat of the mechanics chair 9, each side of the mechanics chair 9 is provided with a diagonal reinforcing member 26, 27. The diagonal reinforcing member 26 connects first seat side member 22 to a first vertical support member 28, which connects the base structure of the mechanics chair 9 to the seat structure. Similarly, the diagonal reinforcing member 27 connects second seat side member 23 to a second vertical support member 29. The first and second vertical support members 28, 29 are disposed generally parallel to one another, and each is disposed generally perpendicular to the first and second base side members 19, 20 and first and second seat side members 22, 23.

In one embodiment, the diagonal reinforcing members 26, 27 form an approximately forty-five (45) degree angle with their respective seat side members 22, 23 and their respective vertical supports members 28, 29.

Figure 24:
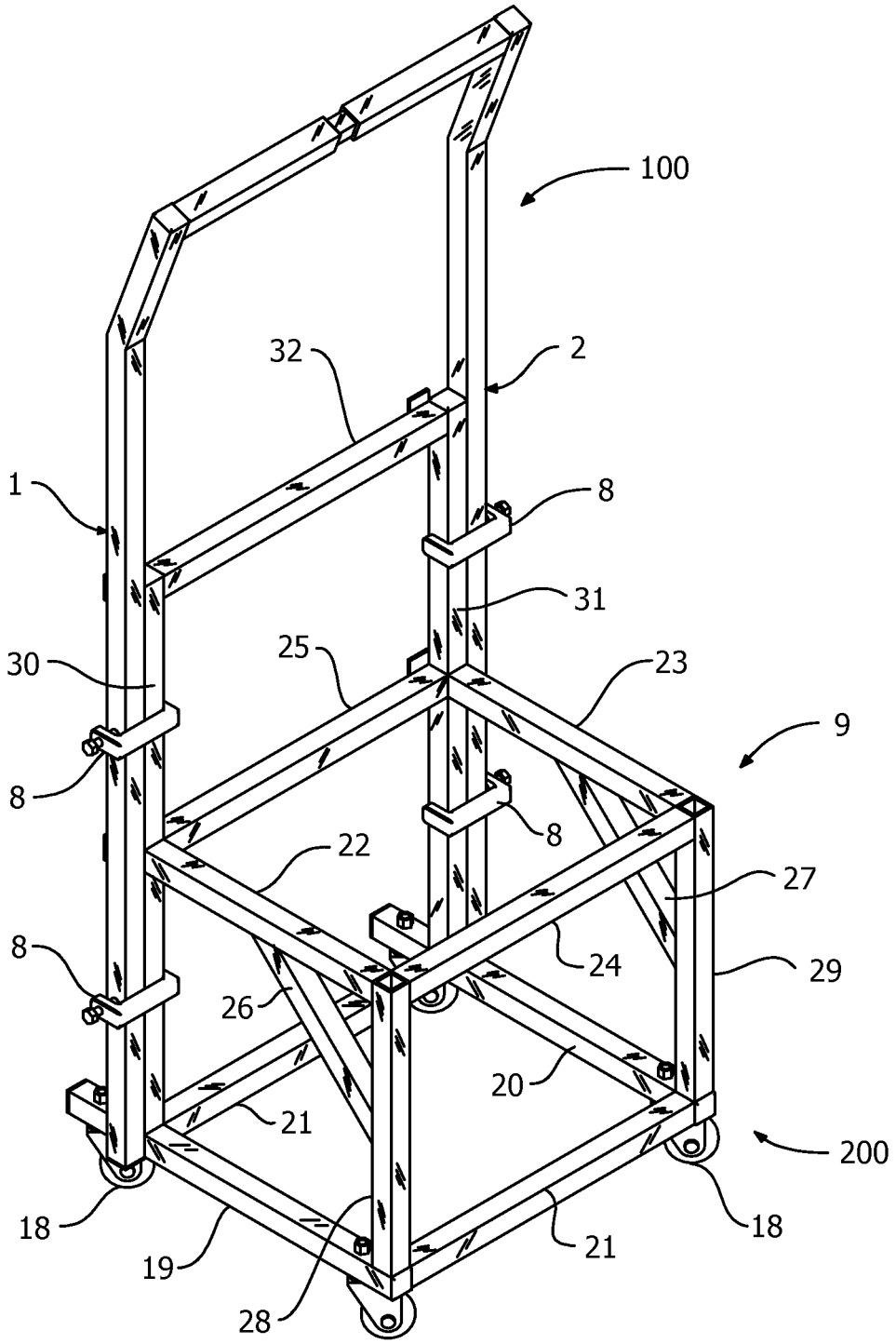
FIG. 24 is a perspective view of the structural frame of the mechanics chair with the two generally L-shaped members of the attachment device attached thereto, according to an embodiment of the invention.

As shown in FIG. 24, the seat back frame structure of the mechanics chair 9 comprises a first vertical frame member 30 and a second vertical frame member 31, which is spaced apart from the first vertical frame member 30 by the length of a transverse seat back member 32. The first and second vertical frame members 30, 31 are disposed generally parallel to one another, and each is disposed generally perpendicular to the first and second seat side members 22, 23 and transverse seat back member 32. In FIG. 24, it can be seen that the attachment assembly 100 is secured to the seat back frame structure of the mechanics chair 9 by means of C-clamps 8. In particular, the first generally L-shaped member 1 is attached to the first vertical frame member 30 of the mechanics chair 9 by two (2) C-clamps 8, while the second generally L-shaped member 2 is attached to the second vertical frame member 31 of the mechanics chair 9 by an additional two (2) C-clamps 8. Advantageously, the attachment assembly 100 provides an elongated backrest, as well as headrest, for a user of the mechanics chair 9. As such, the use of the attachment assembly 100 in conjunction with the mechanics chair 9 enhances comfort, and reduces fatigue, while an individual is servicing a vehicle.

Figure 25:
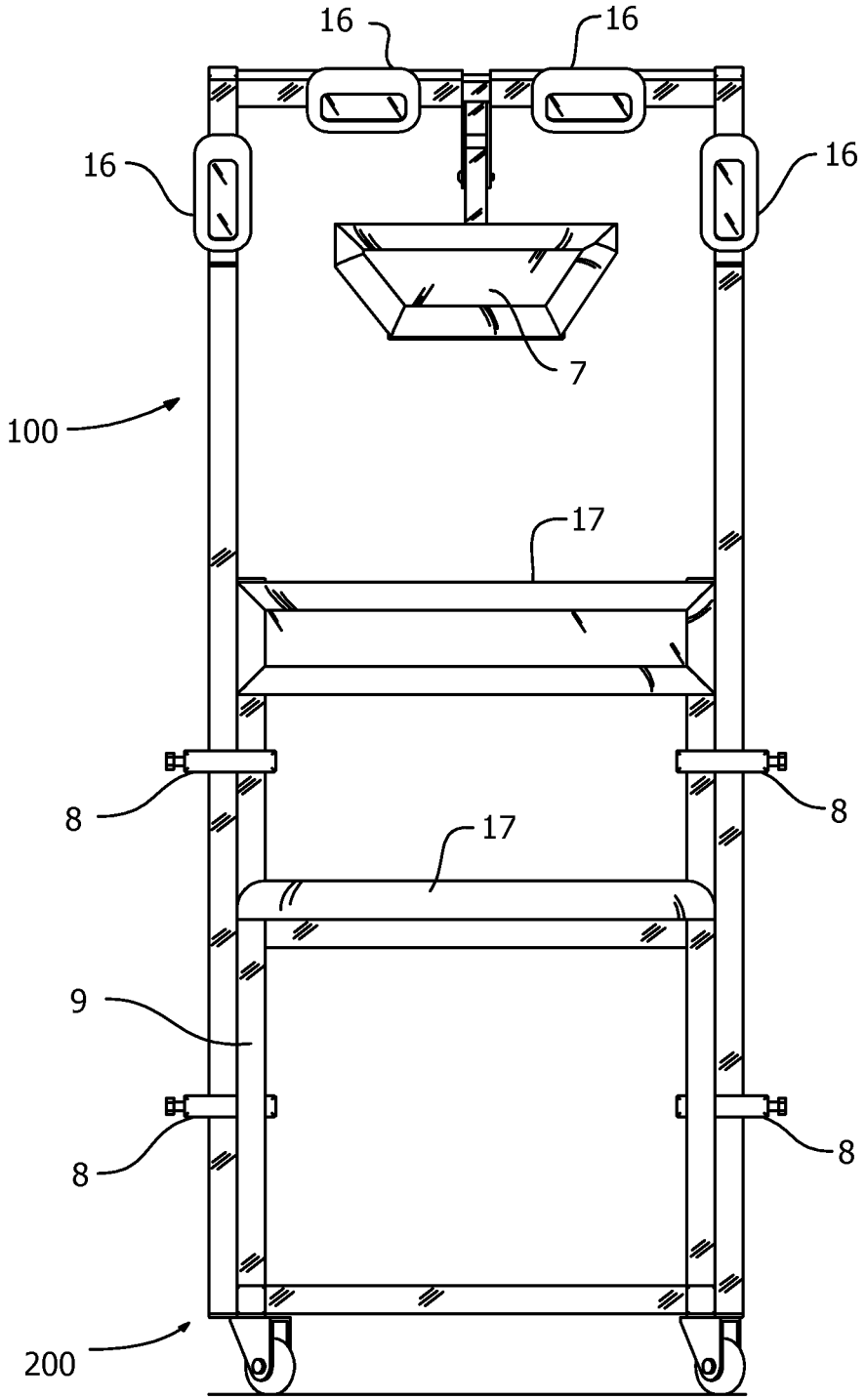
FIG. 25 is a frontal perspective view of a mechanics chair with the attachment device attached thereto, according to an embodiment of the invention, wherein the attachment device includes a headrest and a plurality of removable light emitting devices.
Figure 26:
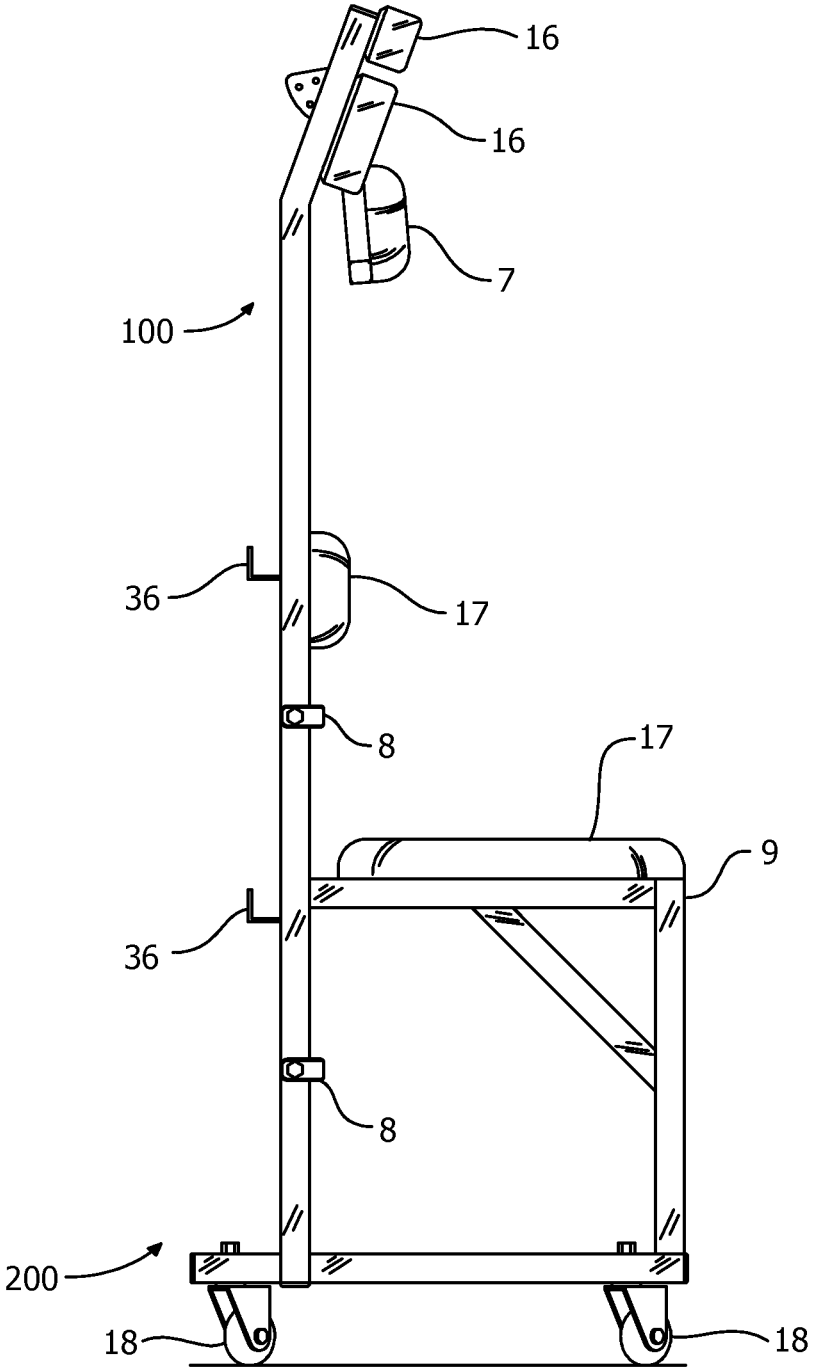
FIG. 26 is a right side view of the mechanics chair with the attachment device attached thereto, according to an embodiment of the invention, wherein the attachment device includes a headrest and a plurality of removable light emitting devices.

In FIGS. 25 and 26, an attachment device 100 with a headrest 7 and removable light emitting devices 16 is shown attached to the mechanics chair 9. In addition, the seat pad 17 of the mechanics chair is depicted in these two figures. Referring to FIG. 26, it can be seen that the base frame of the mechanics chair 9 is provided with a plurality of swiveling wheels 18 (e.g., four wheels 18, with one near each of the respective corners of the base frame). Also, it can be seen that the back side of the mechanics chair 9 is provided with a lower set of hook members 36 and an upper set of hook members 36 for attaching an automotive creeper thereto. The manner in which the hook members 36 are used to attach the creeper to the back side of mechanics chair 9 will be described in further detail hereinafter.

Figure 27:
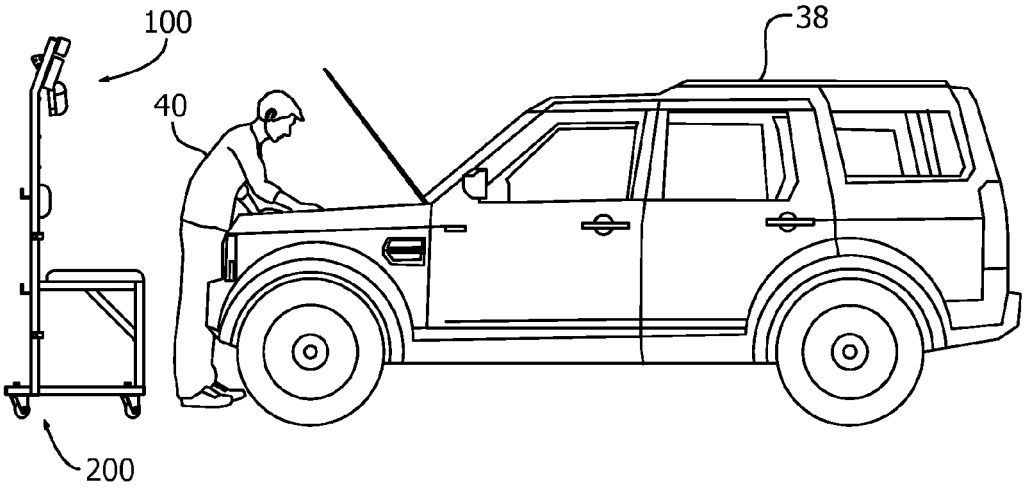
FIG. 27 is another right side view of the mechanics chair with the attachment device attached thereto, according to an embodiment of the invention, wherein the mechanics chair and attachment device assembly is disposed next to a mechanic working under the hood of a vehicle.

Now, referring to FIG. 27, it can be seen that the mechanics chair assembly 200 with the attachment device 100 attached thereto is shown disposed next to a mechanic 40 working under the hood of a vehicle 38. Advantageously, when the mechanics chair assembly 200 and the attachment device 100 are used in this configuration, the light emitting devices 16 disposed at the head end of the attachment device 100 can be used for illuminating the engine compartment of the vehicle 38 so as to facilitate the work being performed on the vehicle 38 by the mechanic 40 (i.e., the light emitting devices 16 provide overhead lighting for the mechanic 40).

Figure 28:
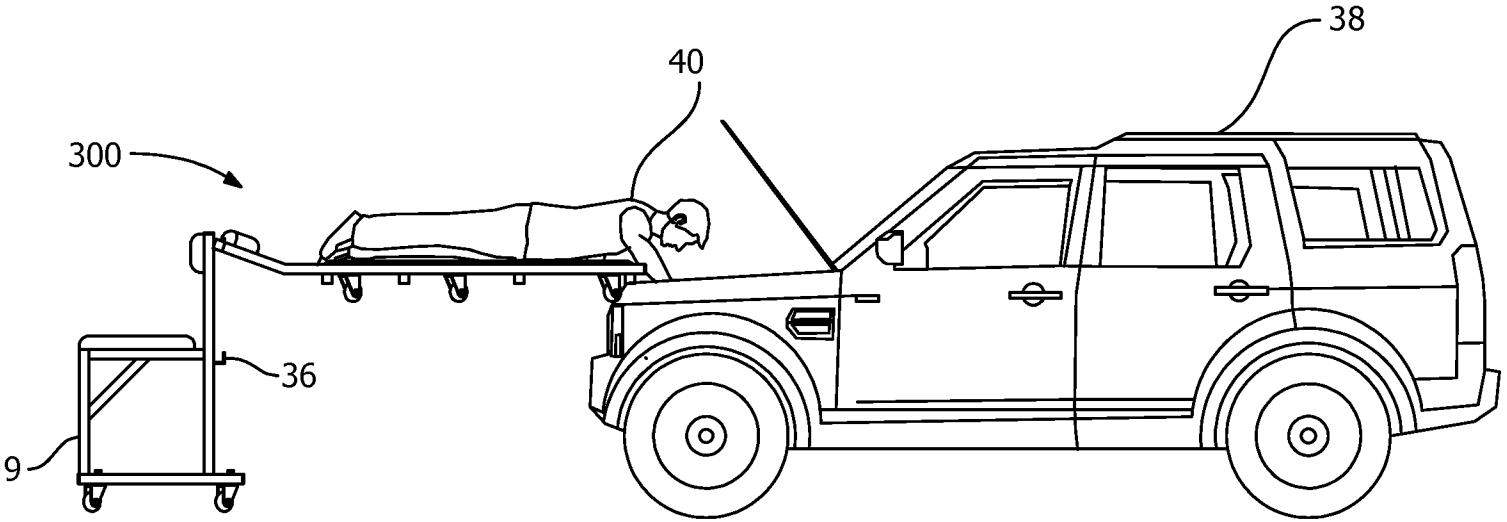
FIG. 28 is a left side view of a mechanics chair with an automotive creeper attached to the top thereof, according to an embodiment of the invention, wherein a head end of the creeper is supported by the mechanics chair and a foot end of the creeper is supported by the front end of a vehicle so that a mechanic can lie on the creeper while working under the hood of the vehicle.

In FIG. 28, an automotive creeper 300 is supported in an elevated, generally horizontal position by the top portion of the mechanics chair 9. Specifically, the head end of the automotive creeper 300 is supported by the upper pair of hook members 36 on the back of the mechanics chair 9, while the foot end of the automotive creeper 300 is supported by the front end of the vehicle 38, namely the front end of the vehicle engine compartment. Advantageously, this configuration of the automotive creeper 300 allows a mechanic 40 to lie down on the elevated creeper 300 while he or she is working under the hood of the vehicle 38, thereby reducing the back fatigue normally experienced by the mechanic 40.

Figure 29:
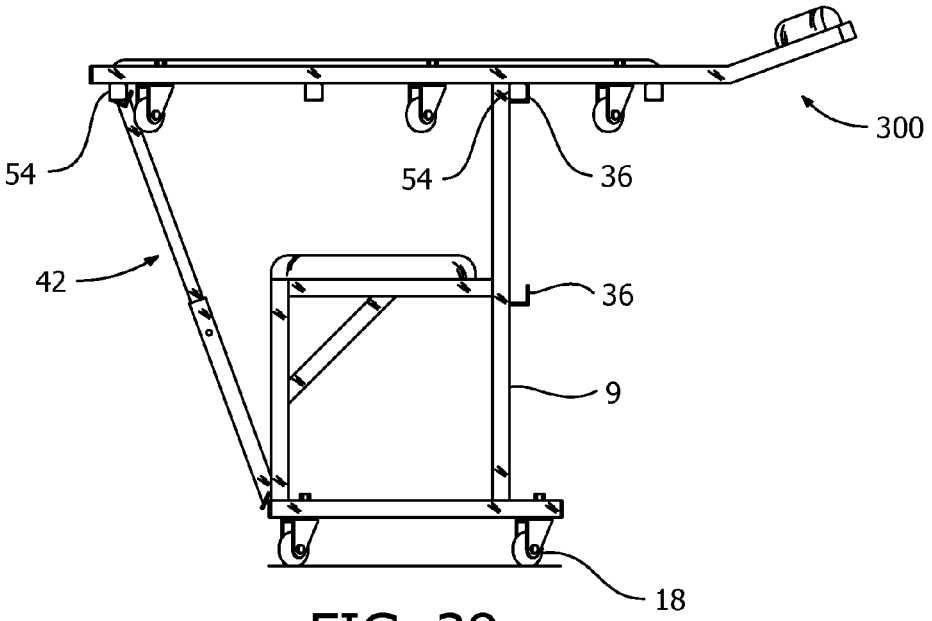
FIG. 29 is a left side view of a mechanics chair with an automotive creeper attached across the top thereof using a diagonally disposed support bar assembly, according to an embodiment of the invention, wherein the automotive creeper on the top of the mechanics chair is configured to be used as a table.
Figure 34:
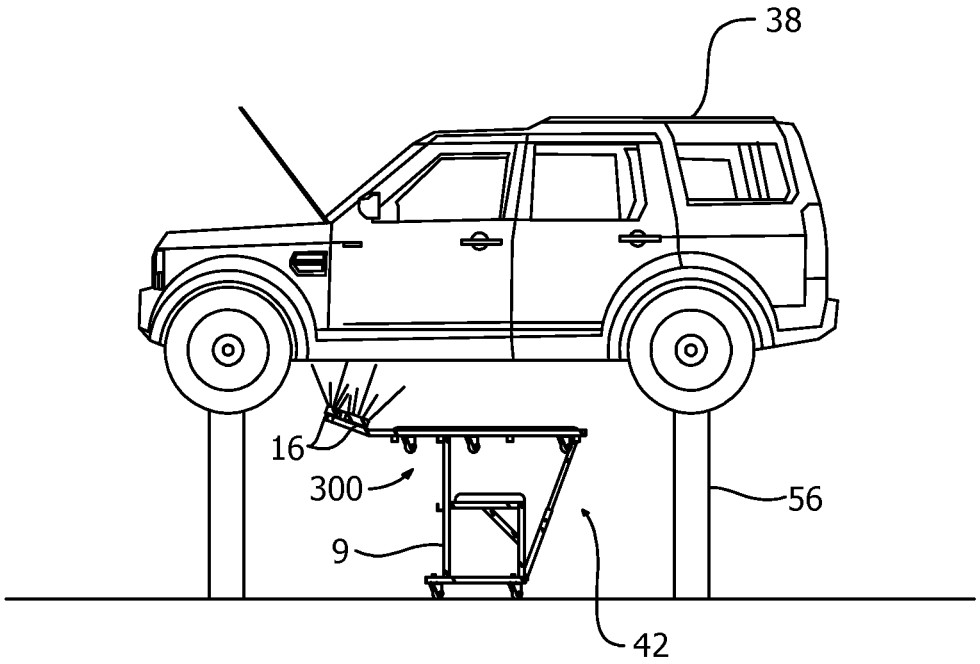
FIG. 34 is a right side view of the mechanics chair and automotive creeper assembly of FIG. 29 disposed underneath a vehicle elevated on a vehicle lift, according to an embodiment of the invention, wherein the automotive creeper on the top of the mechanics chair is configured to be used as a table.

Next, referring to FIG. 29, it can be seen that the automotive creeper 300 may be used as a table when it is attached to the top of the mechanics chair 9. In particular, as illustrated in FIG. 29, a transverse or lateral frame member 54 at the foot end of the automotive creeper 300 is supported from a front base portion of the mechanics chair 9 using an adjustable support bar assembly 42, while a transverse creeper frame member 54 near the middle of the creeper 300 is supported using the top set of hook members 36 on the mechanics chair 9. The configuration illustrated in FIG. 29 allows the chair and creeper assembly 9, 300 to be used as a table for holding tools, etc. Also, it is to be understood that light emitting devices, such as the removable light emitting devices 16, may be placed on the elevated, generally horizontally disposed automotive creeper 300 so that the area underneath a vehicle may be illuminated. For example, as shown in FIG. 34, when a vehicle 38 is elevated on a vehicle lift 56, the automotive creeper 300 may be provided with light emitting devices 16 thereon for illuminating the underside of the vehicle 38, thereby facilitating the work underneath the vehicle 38.

Figure 30:
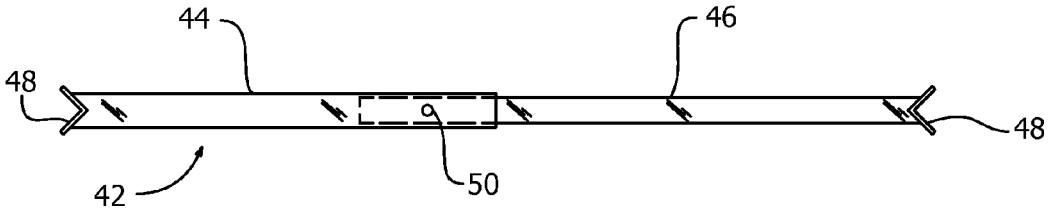
FIG. 30 is a side view of the support bar assembly illustrated in FIG. 29, according to an embodiment of the invention.

The details of the adjustable support bar assembly 42 are illustrated in FIG. 30. With reference to this figure, it can be seen that the adjustable support bar assembly 42 generally comprises a first elongate bar member 44 that is slidably coupled to a second elongate bar member 46 so that the length of the support bar assembly 42 can be selectively adjusted by a user thereof. As shown in FIG. 30, the opposed outer ends of the first and second elongate bar members 44, 46 are each provided with respective angled end cap members 48 for engaging either a transverse frame member 54 of the creeper 300 or a base frame member of the mechanics chair 9. The V-shaped configuration of the end cap members 48 accommodates the diagonal orientation of the support bar assembly 42 when is coupled to the mechanics chair 9 and the automotive creeper 300 (e.g., as shown in FIG. 29). Referring again to FIG. 30, it can be seen that the second elongate bar member 46 has a smaller cross-sectional area than the first elongate bar member 44 so that it is capable of being slidingly received within the inner end of the first elongate bar member 44. As such, the support bar assembly 42 is capable of being adjusted to a desired length by a user thereof. Once the support bar assembly 42 has been adjusted to its desired length by a user, the position of the second inner elongate bar member 46 can be secured in place relative to the first outer elongate bar member 44 by tightening the fastener 50 (e.g., a bolt) against the outer surface of the second inner elongate bar member 46. In this manner, a fixed length of the support bar assembly 42 can be maintained until the fastener 50 is loosened. In one or more embodiments, the first and second elongate bar members 44, 46 may comprise tubular members with a hollow interior.

Figure 31:
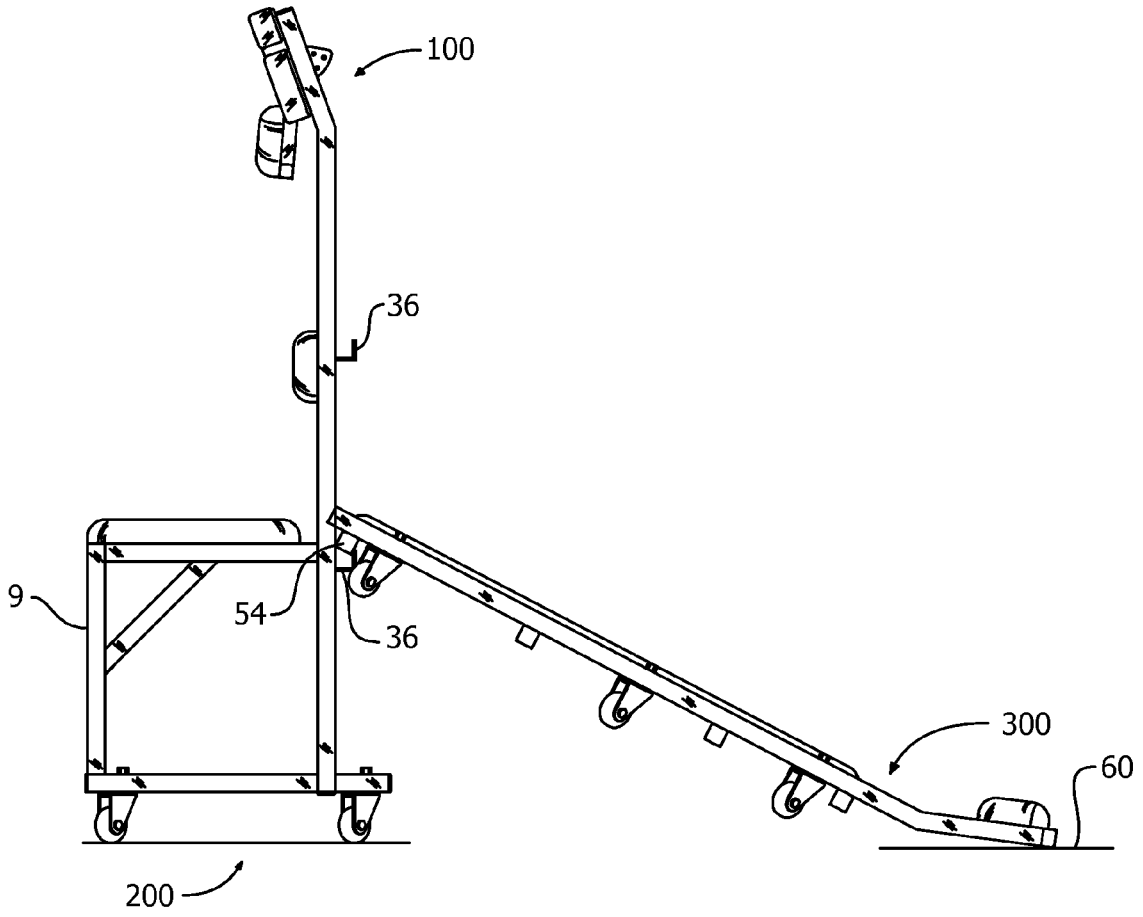
FIG. 31 is a left side view of a mechanics chair with an automotive creeper attached to a back portion thereof in an inclined orientation, according to an embodiment of the invention.

Another possible configuration of the mechanics chair 9 and the automotive creeper 300 is shown in FIG. 31. In this figure, the automotive creeper 300 is disposed in an inclined position with the foot end of the creeper 300 attached to the mechanics chair 9 and the head end of the creeper 300 resting on the ground 60. In particular, a transverse frame member 54 at the foot end of the automotive creeper 300 is engaged with the lower set of hook members 36 on the back of the mechanics chair 9, while the head end of the creeper 300 simply rests on the ground 60. This inclined orientation of the creeper 300 allows a mechanic to be more comfortably supported in an inclined position while he or she is working on a vehicle.

Figure 35:
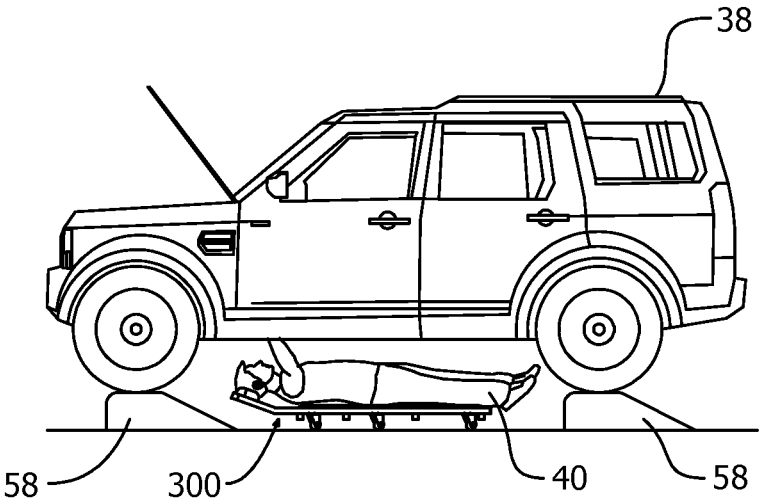
FIG. 35 is a side view of a mechanic working underneath a vehicle, according to an embodiment of the invention, wherein the vehicle is elevated using vehicle wheel ramps.
Figure 36:
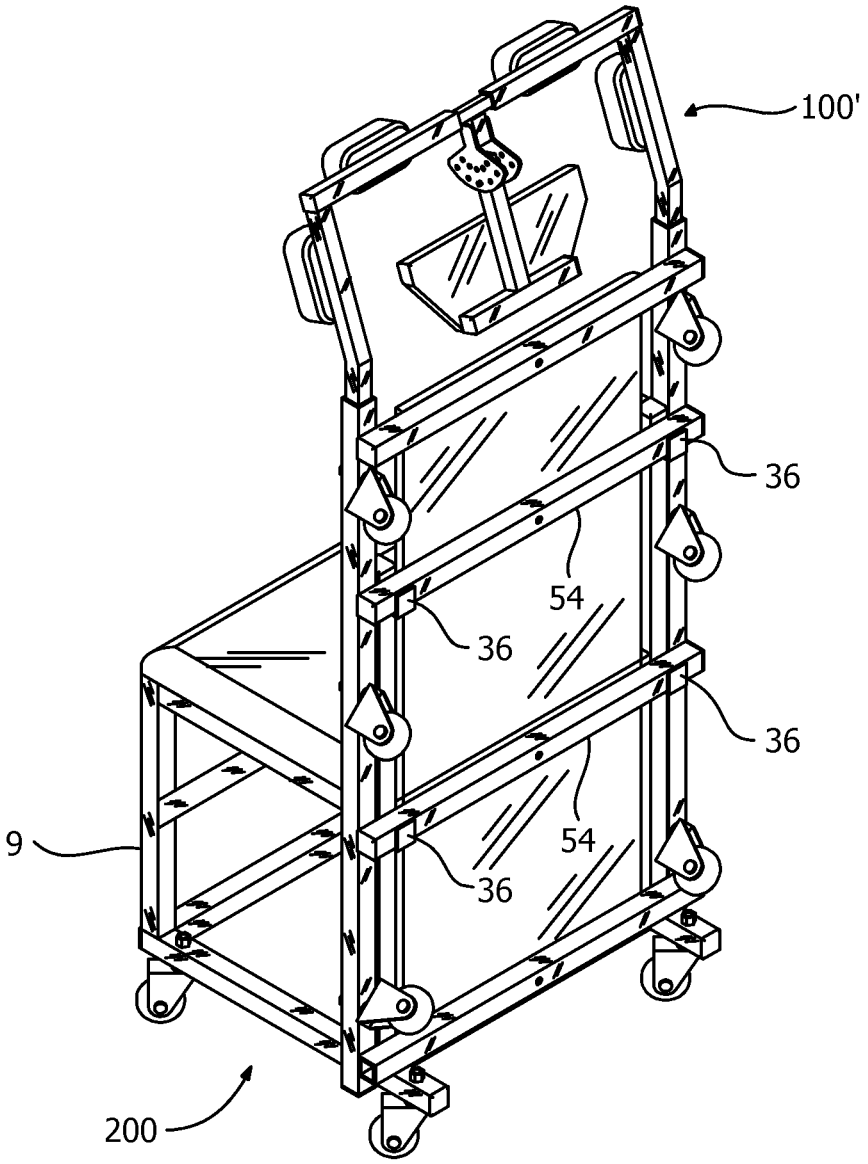
FIG. 36 is a rear perspective view of an automotive creeper attached to the back of a mechanics chair by means of a plurality of hook members disposed on the rear side of the mechanics chair.

FIG. 35 illustrates a mechanic 40 working underneath a vehicle 38 that is elevated on vehicle wheel ramps 58. Similar to that described above in conjunction with FIG. 34, the automotive creeper 300 may be provided with removable light emitting devices 16 disposed thereon for illuminating the underside of the vehicle 38. In FIG. 36, an automotive creeper with an attachment assembly 100' disposed thereon is shown attached to the back of a mechanics chair 9 by means of the hook members 36 disposed on the back side of the mechanics chair 9. In the illustrated embodiment, the hook members 36 are secured to the first and second vertical frame members 30, 31 of the mechanics chair 9. As shown in FIG. 36, a first transverse or lateral frame member 54 of the creeper is detachably coupled to the lower set of hook members 36 on the back of the mechanics chair 9, while a second transverse frame member 54 of the creeper is detachably coupled to the upper set of hook members 36 on the back of the mechanics chair 9. The engagement between the transverse frame members 54 of the automotive creeper and the hook members 36 on the mechanics chair 9 securely couples the automotive creeper to the mechanics chair 9. Although, when it is desired that the creeper be removed from the mechanics chair 9, a user must simply lift the creeper upwardly so that the transverse frame members 54 of the creeper become disengaged from the hook members 36 of the mechanics chair 9.

As described above, one or more embodiments of the invention further include an inventive mechanics chair assembly 200. Advantageously, the attachment device 100, 100', 100" can be removed from the automotive creeper 6 and attached to the mechanics chair 9. The mechanics chair assembly 200 has the rear wheels 18 extended a sufficient distance beyond the back of the chair 9 in order to make the chair 9 less able to be tipped over backwards. It is to be understood that the attachment device 100, 100', 100" can be readily removed from the creeper and attached to the mechanics chair 9. Also, the automotive creeper 300 can be readily attached to the mechanics chair 9. An attachment device 100, 100', 100" or an automotive creeper 300 having light emitting devices 4, 16 can be attached to the mechanics chair 9 so as to provide hands-free light. In this configuration, the light emitting devices 4, 16 move with the mechanic on the mechanics chair 9. The attachment device 100, 100', 100" also doubles as a back support and head pad. This allows for more comfortable, safer work. The attachment device 100, 100', 100" allows the mechanic to lean back to relieve some back/neck fatigue without tipping the chair over backwards. Also, the attachment device 100, 100', 100" can be moved up and down on the mechanics chair 9 for a custom fit and adjustable back/head support.

Figure 32:
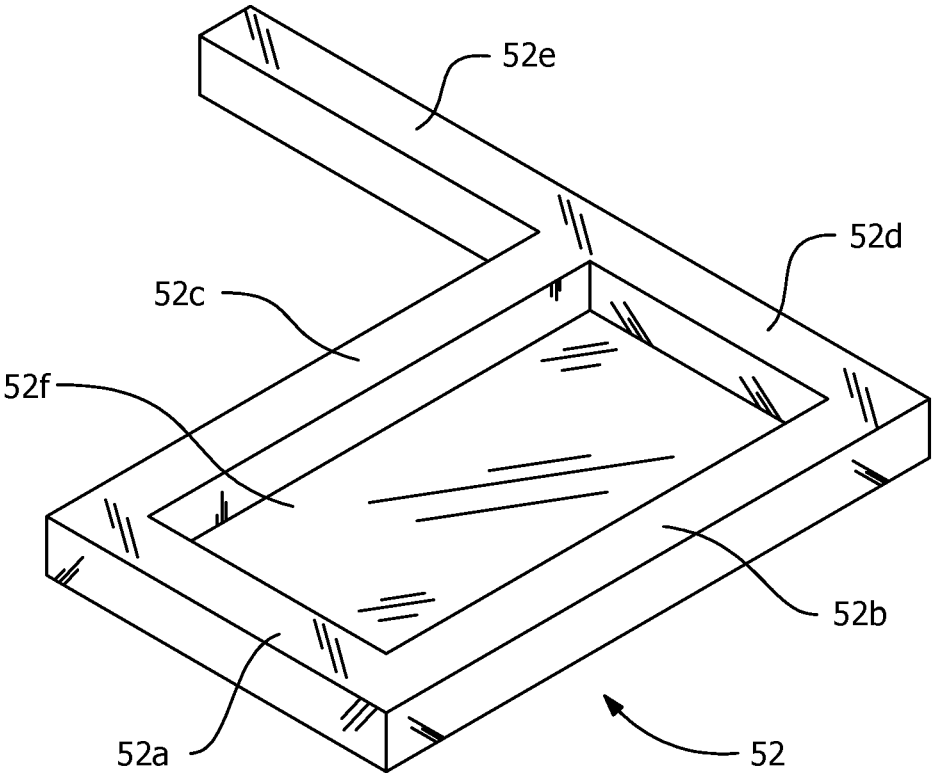
FIG. 32 is a perspective view of a detachable creeper tool tray, according to an embodiment of the invention.
Figure 33:
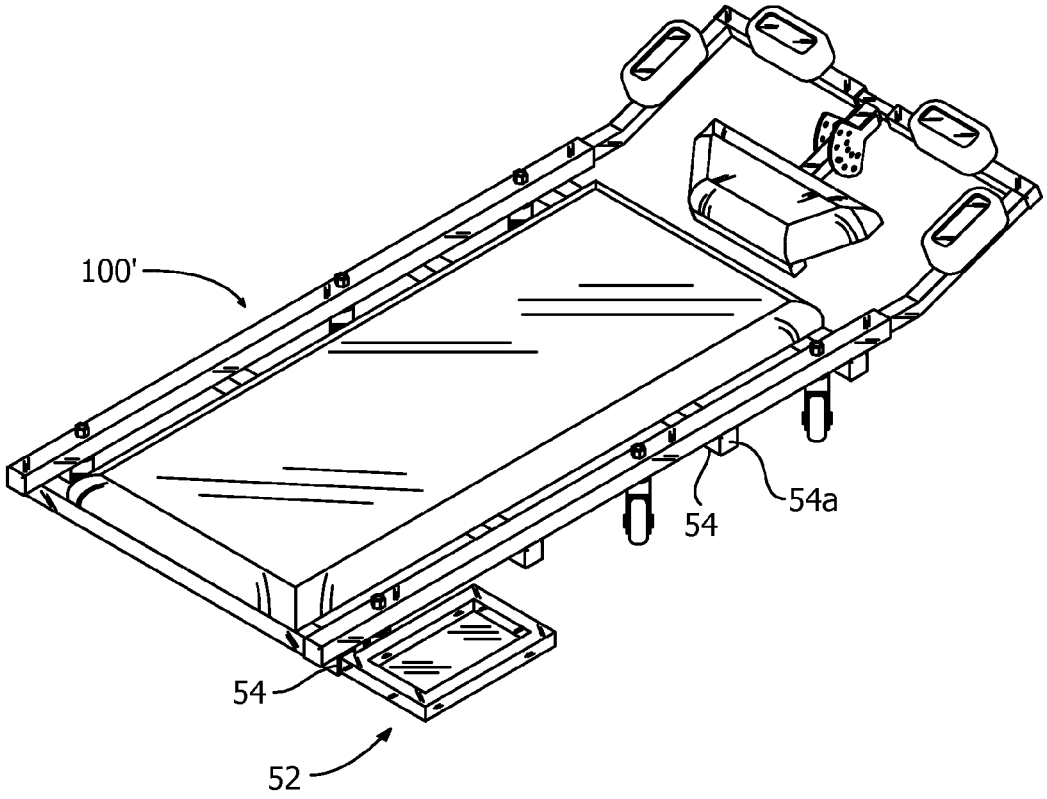
FIG. 33 is a perspective view of the creeper tool tray of FIG. 32 attached to the side of an automotive creeper, according to an embodiment of the invention.

With reference to FIGS. 32 and 33, it can be seen that the automotive creeper with attachment device 100' may be provided with a removable tool tray 52. Referring initially to the perspective view of FIG. 33, it can be seen that the tool tray 52 may be removably coupled to the side of the automotive creeper by inserting an outwardly projecting frame member 52*e* of the tool tray 52 (see FIG. 32) into the open end 54*a* of one of the transverse frame members 54 of the automotive creeper. In FIG. 33, while the tool tray 52 is shown connected to the transverse frame member 54 that is closest to the foot end of the creeper, it is to be understood that the tool tray could also be connected to any of the other three (3) transverse frame member 54 of the creeper depending on the preferential placement of the tool tray 52 by the user (i.e., the mechanic). In order to remove the tool tray 52, a user simply slides the outwardly projecting frame member 52*e* of the tool tray 52 out of the receiving open end 54*a* of the transverse frame member 54. Advantageously, the tool tray 52 can be rotated and installed in different ways to accommodate the user when he or she is lying on the automotive creeper or when he or she is sitting in the mechanics chair 9 with creeper disposed behind him or her.

The details of the removable tool tray 52 are illustrated in FIG. 32. As shown in this figure, the tool tray 52 generally comprises a plurality of frame members 52*a*, 52*b*, 52*c*, 52*d*, 52*e* and a bottom plate member 52*f*. In particular, the tool tray 52 comprises four (4) frame members 52*a*, 52*b*, 52*c*, 52*d* that are arranged in a rectangular configuration. The frame members 52*a*, 52*d* are disposed generally parallel to one another and are respectively located on opposite sides of the bottom plate member 52*f*. Similarly, the frame members 52*b*, 52*c* are disposed generally parallel to one another and are respectively located on opposite sides of the bottom plate member 52*f*. Also, as shown in FIG. 32, each of the frame members 52*a*, 52*d* is disposed generally perpendicular to each of the frame members 52*b*, 52*c* so as to form a rectangular frame circumscribing the rectangular bottom plate 52*f*. With reference again to FIG. 32, it can be seen that the rectangular bottom plate 52*f* is attached to the bottom surfaces of the frame members 52*a*, 52*b*, 52*c*, 52*d*. In the illustrated embodiment of FIG. 32, the outwardly projecting frame member 52*e* is generally co-linear with the side frame member 52*d* (i.e., the projecting frame member 52*e* extends generally linearly outwardly from the end of the frame member 52*d* that engages the frame member 52*c*).

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. An attachment device configured to be attached to opposed sides of an automotive creeper, said attachment device comprising:

a first generally L-shaped member, said first generally L-shaped member including a head portion and a side portion, said head portion of said first generally L-shaped member having an end;

a second generally L-shaped member, said second generally L-shaped member including a head portion and a side portion, said head portion of said second generally L-shaped member having an end;

a connecting member, said connecting member slidably coupling said end of said head portion of said first generally L-shaped member to said end of said head portion of said second generally L-shaped member, said connecting member comprising a generally T-shaped member having a base portion and a cross-piece connected to an end of said base portion, said cross-piece of said generally T-shaped member having first and second opposed ends and a cross-sectional area, at least a portion of said cross-sectional area of said cross-piece being less than a cross-sectional area of said first and second generally L-shaped members, said first end of said cross-piece of said generally T-shaped member slidably engaging said end of said head portion of said first generally L-shaped member, said second end of said cross-piece of said generally T-shaped member slidably engaging said end of said head portion of said second generally L-shaped member; and at one least pair of securement devices, a first of said at least one pair of securement devices configured to attach said side portion of said first generally L-shaped member to a first side member of an automotive creeper, and a second of said at least one pair of securement devices configured to attach said side portion of said second generally L-shaped member to a second side member of said automotive creeper, said second side member of said automotive creeper being disposed generally opposite to said first side member of said automotive creeper;

wherein a width of said attachment device is selectively adjustable so as to accommodate a plurality of different automotive creepers having varying widths.

2. The attachment device according to claim 1, wherein said first and second generally L-shaped members are in the form of generally L-shaped tubular members, wherein said head portions of said first and second generally L-shaped members are disposed at substantially ninety degree angles relative to respective said side portions of said first and second generally L-shaped members; and wherein said side portions of said first and second generally shaped members are each upwardly bent at an angle near a head end of said attachment device so as to accommodate an inclined head position of a user disposed on said automotive creeper.

3. The attachment device according to claim 1, wherein said head portion of said first generally L-shaped member comprises a first fastener threadingly disposed in an aperture thereof, said head portion of said second generally L-shaped member comprises a second fastener threadingly disposed in an aperture thereof, said first and second fasteners configured to be tightened against respective outer surfaces of said generally T-shaped member proximate to respective said first and second ends of said cross-piece of said generally T-shaped member so as to fix the position of said first generally L-shaped member relative to said second generally L-shaped member.

4. The attachment device according to claim 3, further comprising a headrest attached to said generally T-shaped member.

5. The attachment device according to claim 4, wherein an angle of said headrest is selectively adjustable by a user.

6. The attachment device according to claim 1, further comprising one or more light emitting devices for providing light to an area of a vehicle being serviced.

7. The attachment device according to claim 6, wherein said one or more light emitting devices comprise light emitting diode (LED) lamps.

8. The attachment device according to claim 6, wherein said one or more light emitting devices comprise a plurality of light emitting devices spaced apart along the length of at least one of the following: (i) said side portion of said first generally L-shaped member, (ii) said head portion of said first generally L-shaped member, (iii) said side portion of said second generally L-shaped member, and (iv) said head portion of said second generally L-shaped member.

9. The attachment device according to claim 8, wherein said plurality of light emitting devices are spaced apart along the length of said side portions of said first and second generally L-shaped members and said head portions of said first and second generally L-shaped members.

10. The attachment device according to claim 6, wherein said one or more light emitting devices comprise a plurality of removable light emitting devices, each of said plurality of removable light emitting devices comprising one or more magnets for attaching said removable light emitting devices to said attachment device.

11. An automotive creeper system, comprising:

an automotive creeper, said automotive creeper including a first side member and a second side member, said second side member of said automotive creeper being disposed generally opposite to said first side member of said automotive creeper; and an attachment device coupled to said first and second side members of said automotive creeper, said attachment device including:

a first generally L-shaped member, said first generally L-shaped member including a head portion and a side portion, said head portion of said first generally L-shaped member having an end;

a second generally L-shaped member, said second generally L-shaped member including a head portion and a side portion, said head portion of said second generally L-shaped member having an end;

a connecting member, said connecting member slidably coupling said end of said head portion of said first generally L-shaped member to said end of said head portion of said second generally L-shaped member, said connecting member of said attachment device comprising a generally T-shaped member having a base portion and a cross-piece connected to an end of said base portion, said cross-piece of said generally T-shaped member having first and second opposed ends and a cross-sectional area, at least a portion of said cross-sectional area of said cross-piece being less than a cross-sectional area of said first and second generally L-shaped members, said first end of said cross-piece of said generally T-shaped member slidably engaging said end of said head portion of said first generally L-shaped member, said second end of said cross-piece of said generally T-shaped member slidably engaging said end of said head portion of said second generally L-shaped member; and at one least pair of securement devices, a first of said at least one pair of securement devices attaching said side portion of said first generally L-shaped member to said first side member of said automotive creeper, and a second of said at least one pair of securement devices attaching said side portion of said second generally L-shaped member to said second side member of said automotive creeper;

wherein a width of said attachment device is selectively adjustable so as to accommodate a plurality of different automotive creepers having varying widths.

12. The automotive creeper system according to claim 11, further comprising a headrest attached to said generally T-shaped member.

13. The automotive creeper system according to claim 12, wherein an angle of said headrest is selectively adjustable by a user.

14. The automotive creeper system according to claim 11, wherein said attachment device further comprises one or more light emitting devices for providing light to an area of a vehicle being serviced.

15. The automotive creeper system according to claim 14, wherein said one or more light emitting devices comprise light emitting diode (LED) lamps.

16. A mechanics chair comprising, in combination:

a seat portion, said seat portion including a plurality of seat members, a first of said plurality of seat members being laterally spaced apart from a second of said plurality of seat members;

a seat back portion coupled to said seat portion, said seat back portion including a plurality of seat back members, a first of said plurality of seat back members being laterally spaced apart from a second of said plurality of seat back members;

a base portion, said base portion including a plurality of base members, a first of said plurality of base members being laterally spaced apart from a second of said plurality of base members, at least one of said plurality of base members extending beyond said seat back portion of said mechanics chair so as to prevent the tipping thereof;

a leg structure coupling said seat portion to said base portion, said leg structure including a plurality of generally vertical leg members, each of said plurality of generally vertical leg members spaced apart from one another, a first of said plurality of generally vertical leg members coupling said first of said plurality of base members to said first of said plurality of seat members, and a second of said plurality of generally vertical leg members coupling said second of said plurality of base members to said second of said plurality of seat members; and an attachment device coupled to said seat back portion of said mechanics chair, said attachment device including:

a first generally L-shaped member, said first generally L-shaped member including a head portion and a side portion, said head portion of said first generally L-shaped member having an end;

a second generally L-shaped member, said second generally L-shaped member including a head portion and a side portion, said head portion of said second generally L-shaped member having an end;

a connecting member, said connecting member slidably coupling said end of said head portion of said first generally L-shaped member to said end of said head portion of said second generally L-shaped member, said connecting member of said attachment device comprising a generally T-shaped member having a base portion and a cross-piece connected to an end of said base portion, said cross-piece of said generally T-shaped member having first and second opposed ends and a cross-sectional area, at least a portion of said cross-sectional area of said cross-piece being less than a cross-sectional area of said first and second generally L-shaped members, said first end of said cross-piece of said generally T-shaped member slidably engaging said end of said head portion of said first generally L-shaped member, said second end of said cross-piece of said generally T-shaped member slidably engaging said end of said head portion of said second generally L-shaped member; and at one least pair of securement devices, a first of said at least one pair of securement devices attaching said side portion of said first generally L-shaped member to said first of said plurality of seat back members, and a second of said at least one pair of attachment devices attaching said side portion of said second generally L-shaped member to said second of said plurality of seat back members.

17. The mechanics chair according to claim 16, wherein said plurality of seat members comprise a first pair of seat side members and a second pair of transverse seat members, said seat side members being spaced apart from one another by the length of said transverse seat members; and wherein each of said seat side members is disposed generally perpendicular to each of said transverse seat members.

18. The mechanics chair according to claim 16, wherein said plurality of seat back members comprise a pair of seat back side members and a transverse seat back member, said seat back side members being spaced apart from one another by the length of said transverse seat back member; and wherein each of said seat back side members is disposed generally perpendicular to said transverse seat back member.

19. The mechanics chair according to claim 16, wherein said plurality of base members comprises a pair of base side members and a transverse base member, said base side members being spaced apart from one another by the length of said transverse base member; wherein each of said base side members is disposed generally perpendicular to said transverse base member; and wherein each of said base side members comprises a plurality of wheels coupled thereto, at least one of said plurality of wheels on said each base side member being disposed rearwardly of said seat back portion of said mechanics chair so as to prevent the tipping thereof.

20. The mechanics chair according to claim 16, further comprising a pair of diagonal members, a first of said pair of said diagonal members coupling said first of said plurality of generally vertical leg members to said first of said plurality of seat members, and a second of said pair of said diagonal members coupling said second of said plurality of generally vertical leg members to said second of said plurality of seat members; and wherein said seat portion of said mechanics chair further comprises a padded seat.

* * * * *